US009346278B2

(12) United States Patent
Ishizawa et al.

(10) Patent No.: US 9,346,278 B2
(45) Date of Patent: May 24, 2016

(54) PACKAGING TRAY AND PACKAGING BODY

(71) Applicant: Seiko Epson Corporation, Tokyo (JP)

(72) Inventors: Taku Ishizawa, Matsumoto (JP); Hiroyuki Kawate, Hokuto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/703,621

(22) Filed: May 4, 2015

(65) Prior Publication Data

US 2015/0321481 A1 Nov. 12, 2015

(30) Foreign Application Priority Data

May 8, 2014 (JP) ..... 2014-096558

(51) Int. Cl.
*B41J 2/175* (2006.01)

(52) U.S. Cl.
CPC ..... *B41J 2/17533* (2013.01)

(58) Field of Classification Search
CPC ..... B41J 2/17533
USPC ..... 347/86
See application file for complete search history.

(56) References Cited

U.S. PATENT DOCUMENTS 4,322,018 A * 3/1982 Rutter ..... B65D 47/263 222/105
2009/0290001 A1* 11/2009 Domae ..... B41J 2/17513 347/85
2011/0259916 A1* 10/2011 Spivey, Sr. ..... B65D 5/4208 222/105

FOREIGN PATENT DOCUMENTS

JP 2007-083497 A 4/2007
JP 2009-202346 A 9/2009

* cited by examiner

*Primary Examiner* — Stephen Meier
*Assistant Examiner* — Alexander D Shenderov

(57) ABSTRACT

For a liquid container provided with a handle portion, some contrivance is necessary with respect to the distribution form from the standpoint of protecting the liquid container against breakage. In a packaging tray for an ink container, the ink container having a flexible ink bag, a supply portion provided in the ink bag, and a handle portion provided in the ink bag and protruding outward therefrom, the packaging tray includes a restricting portion that restricts the handle portion at such a position that a clearance is maintained between the supply portion of the ink container and the packaging tray.

16 Claims, 28 Drawing Sheets

PACKAGING TRAY AND PACKAGING BODY

BACKGROUND

1. Technical Field

The present invention relates to a packaging tray, a packaging body, and the like.

2. Related Art

In recent years, inkjet printers are known as an example of liquid ejection apparatuses. Generally, inkjet printers can perform printing onto a print medium such as paper by directing jets of ink from a print head toward the print medium. With respect to such printers, in recent years, a configuration is known in which an external ink supply apparatus (liquid supply apparatus) is connected to the printer in order to stably supply ink to the print head (see JP-A-2009-202346, for example).

In an external ink supply apparatus disclosed in JP-A-2009-202346, ink contained in an ink pack, which is an example of a liquid container, is supplied to a print head via an ink tube. This ink pack is flexible and is used in a state in which the ink pack is suspended from a support. If such an ink pack is provided with a handle portion (handle), the ink pack is easy to deal with. JP-A-2007-83497 discloses an ink pack tray (packaging tray) that absorbs an impact on an ink pack during conveyance of the ink pack. However, the ink pack disclosed in JP-A-2007-83497 is not provided with a handle portion. A liquid container provided with a handle portion has the problem in that some contrivance is necessary with respect to the distribution form from the standpoint of protecting the liquid container against breakage.

SUMMARY

Some aspects of the invention can solve at least the above-described problem and may be realized as the following forms or application examples.

Application Example 1

A packaging tray for a liquid container, wherein the liquid container has a flexible liquid containing portion, a liquid outlet portion provided in the liquid containing portion, and a handle portion provided in the liquid containing portion and protruding outward therefrom, and the packaging tray includes a restricting portion that restricts the handle portion at such a position that a clearance is maintained between the liquid outlet portion of the liquid container and the packaging tray.

With the packaging tray of this application example, the position of the handle portion is restricted by the restricting portion, so that a clearance is maintained between the liquid outlet portion of the liquid container and the packaging tray. That is to say, with this packaging tray, the liquid outlet portion can be prevented from coming into contact with the packaging tray by restricting the position of the handle portion. Thus, breakage of the liquid outlet portion of the liquid container caused by the liquid outlet portion coming into contact with the packaging tray is easily suppressed.

Application Example 2

In the above-described packaging tray, the liquid outlet portion may be located on the side of the handle portion in the liquid container, and the packaging tray may further include a sloping portion opposing a region of the liquid containing portion that is located on a side opposite to the handle portion with respect to the liquid outlet portion.

With the packaging tray of this application example, when a liquid within the liquid containing portion shakes and moves from the side of the liquid containing portion toward the side of the handle portion, the momentum of the shaking liquid can be alleviated by the sloping portion. Thus, the collision of the liquid outlet portion with the packaging tray due to the momentum of the shaking liquid is easily avoided.

Application Example 3

In the above-described packaging tray, the handle portion may be joined to one end side of the liquid containing portion, a recess that can receive the liquid containing portion may be provided in a portion of the packaging tray that opposes the liquid containing portion, and a sloping portion may be provided in the recess, the sloping portion being sloped in such a direction that a depth of the recess decreases from the side of the liquid containing portion toward the side of the handle portion.

With the packaging tray of this application example, when a liquid within the liquid containing portion shakes and moves from the side of the liquid containing portion toward the side of the handle portion, the momentum of the shaking liquid can be alleviated by the sloping portion. Thus, the force that is exerted on a joint portion between the handle portion and the liquid containing portion due to the momentum of the shaking liquid can be reduced. Therefore, damage to the joint portion between the handle portion and the liquid containing portion is easily avoided.

Application Example 4

In the above-described packaging tray, an end surface of the liquid outlet portion of the liquid container may be directed in a second direction that intersects a first direction, the first direction being a direction in which the handle portion protrudes, and the restricting portion may restrict the position of the handle portion in the second direction.

With the packaging tray of this application example, with respect to the second direction, in which the end surface of the liquid outlet portion is directed, the liquid outlet portion can be prevented from coming into contact with the packaging tray. Thus, with respect to at least the second direction, breakage of the liquid outlet portion of the liquid container caused by the liquid outlet portion coming into contact with the packaging tray is easily suppressed.

Application Example 5

In the above-described packaging tray, an end surface of the liquid outlet portion of the liquid container may be directed in a second direction that intersects a first direction, the first direction being a direction in which the handle portion protrudes, and the restricting portion may restrict the position of the handle portion in a third direction that intersects both of the first direction and the second direction.

With the packaging tray of this application example, with respect to the third direction, which intersects both of the first direction and the second direction, the liquid outlet portion can be prevented from coming into contact with the packaging tray. Thus, with respect to the third direction, breakage of the liquid outlet portion of the liquid container caused by the liquid outlet portion coming into contact with the packaging tray is easily suppressed.

Application Example 6

In the above-described packaging tray, an end surface of the liquid outlet portion of the liquid container may be directed in a second direction that intersects a first direction, the first direction being a direction in which the handle portion protrudes, and the restricting portion may restrict the position of the handle portion in the first direction.

With the packaging tray of this application example, with respect to the first direction, the liquid outlet portion can be prevented from coming into contact with the packaging tray. Thus, with respect to the first direction, breakage of the liquid outlet portion of the liquid container caused by the liquid outlet portion coming into contact with the packaging tray is easily suppressed.

Application Example 7

In the above-described packaging tray, the liquid container may include an electrical connection portion on the side of the handle portion in the liquid containing portion, the electrical connection portion being electrically connectable to an electric circuit of a liquid ejection apparatus, and the restricting portion may restrict the handle portion at such a position that a clearance is maintained between the electrical connection portion and the packaging tray.

With the packaging tray of this application example, the position of the handle portion is restricted by the restricting portion, so that a clearance is maintained between the electrical connection portion of the liquid container and the packaging tray. That is to say, with this packaging tray, the electrical connection portion can be prevented from coming into contact with the packaging tray by restricting the position of the handle portion. Thus, breakage of the electrical connection portion of the liquid container caused by the electrical connection portion coming into contact with the packaging tray is easily suppressed.

Application Example 8

A packaging body including the above-described packaging tray and the liquid container.

With the packaging body of this application example, the position of the handle portion is restricted by the restricting portion of the packaging tray, so that a clearance is maintained between the liquid outlet portion of the liquid container and the packaging tray. That is to say, with the packaging tray of this packaging body, the liquid outlet portion can be prevented from coming into contact with the packaging tray by restricting the position of the handle portion. Thus, breakage of the liquid outlet portion of the liquid container caused by the liquid outlet portion coming into contact with the packaging tray is easily suppressed.

Application Example 9

In the above-described packaging body, the liquid container may have a gusset portion in the liquid containing portion, and the packaging body may further include a spacer that is inserted into the gusset portion and keeps the gusset portion in an expanded state.

With the packaging body of this application example, the gusset portion can be kept in an expanded state by the spacer. Thus, deformation that repeatedly occurs in the gusset portion when, for example, the packaging body is shaken can be reduced. Therefore, fatigue failure due to repeatedly occurring deformation is easily suppressed.

Application Example 10

The above-described packaging body may include an exterior box containing the liquid container and the packaging tray.

With the packaging body of this application example, since the liquid container and the packaging tray can be contained in the exterior box, the liquid container and the packaging tray are easily protected.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
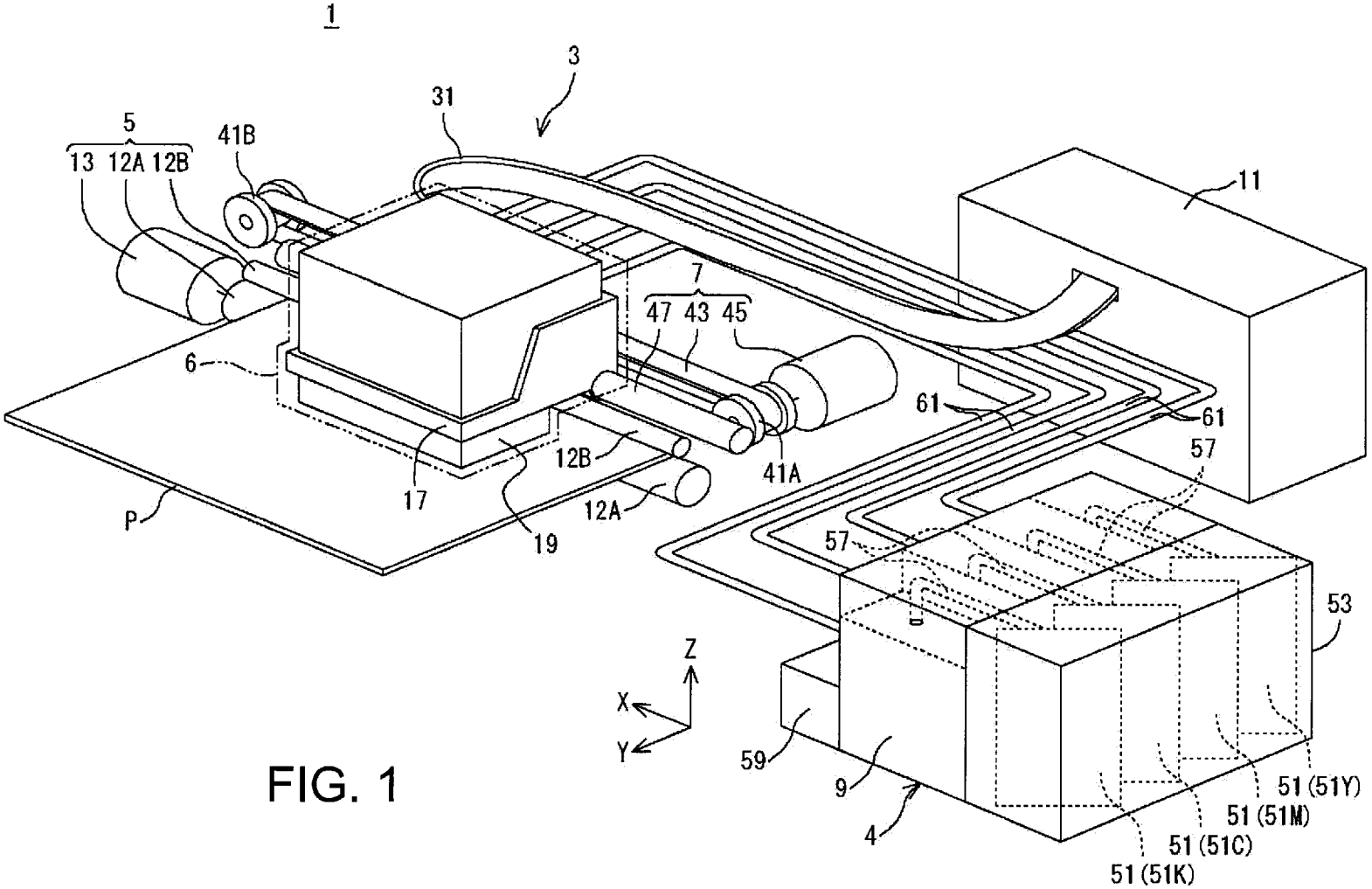
FIG. 1 is a perspective view showing main components of a printer according to an embodiment of the invention.

The following describes an embodiment of the invention with reference to the drawings, taking a liquid ejection system as an example. In the drawings, in order to show individual components in recognizable sizes, the components and members may be shown on different scales.

A liquid ejection system 1 according to the present embodiment has, as shown in FIG. 1, a printer 3, which is an example of a liquid ejection apparatus, and an ink supply apparatus 4, which is an example of a liquid supply apparatus. The printer 3 has a conveyance device 5, a recording unit 6, a moving device 7, a relay device 9, and a control unit 11. It should be noted that in FIG. 1, X-, Y-, and Z-axes, which are coordinate axes that are orthogonal to one another, are shown. The X-, Y-, and Z-axes may also be shown in the drawings described below as necessary. In the present embodiment, a state in which the liquid ejection system 1 is disposed in a horizontal plane (XY plane) defined by the X-axis and the Y-axis is the state in which the liquid ejection system 1 is used. The Z-axis is the axis that is orthogonal to that horizontal plane. In the state in which the liquid ejection system 1 is used, the direction of the Z-axis is a vertically upward direction. Also, in the state in which the liquid ejection system 1 is used, the direction of the negative Z-axis in FIG. 1 is a vertically downward direction. It should be noted that with respect to each of the X-, Y-, and Z-axes, the direction of the arrow indicates the +(positive) direction, and the direction opposite to the direction of the arrow indicates the – (negative) direction.

The conveyance device 5 intermittently conveys a recording medium P such as recording paper in the direction of the Y-axis. The recording unit 6 performs recording onto the recording medium P that is being conveyed by the conveyance device 5 with ink, which is an example of a liquid. The moving device 7 moves the recording unit 6 backward and forward along the X-axis. The ink supply apparatus 4 supplies ink to the recording unit 6 via the relay device 9. The relay device 9 is provided between the ink supply apparatus 4 and the recording unit 6 and relays the ink from the ink supply apparatus 4 to the recording unit 6. The control unit 11 controls driving of the above-described various components.

The conveyance device 5 has, as shown in FIG. 1, a driving roller 12A, a driven roller 12B, and a conveyance motor 13. The driving roller 12A and the driven roller 12B are configured to be able to rotate with their outer circumferences being brought into contact with each other. The conveyance motor 13 generates power for rotating the driving roller 12A. The power from the conveyance motor 13 is transferred to the driving roller 12A via a driving mechanism. Then, the recording medium P sandwiched between the driving roller 12A and the driven roller 12B is intermittently conveyed in the direction of the Y-axis.

The recording unit 6 includes a carriage 17 and a recording head 19. The recording head 19 ejects ink as ink droplets, thereby performing recording onto the recording medium P. The carriage 17 is equipped with the recording head 19. It should be noted that the recording head 19 is connected to the control unit 11 via a flexible cable 31. The ejection of ink droplets from the recording head 19 is controlled by the control unit 11.

The moving device 7 includes, as shown in FIG. 1, a timing belt 43, a carriage motor 45, and a guide shaft 47. The timing belt 43 is stretched between a pair of pulleys 41A and 41B. The pair of pulleys 41A and 41B are arranged in line along the X-axis. Thus, the timing belt 43 is stretched along the X-axis. The carriage motor 45 generates power for rotating the pulley 41A. The guide shaft 47 extends along the X-axis. The guide shaft 47 is supported by a housing, which is not shown, at both ends and guides the carriage 17 along the X-axis.

The carriage 17 is fixed to a portion of the timing belt 43. The power is transferred from the carriage motor 45 to the carriage 17 via the pulley 41A and the timing belt 43. Moreover, the carriage 17 is configured to be able to be moved backward and forward along the X-axis by the transferred power.

The ink supply apparatus 4 has, as shown in FIG. 1, an ink container 51, which is an example of a liquid container, and a case 53. It should be noted that in the present embodiment, the ink supply apparatus 4 includes a plurality of (four in the present embodiment) ink containers 51. The four ink containers 51 are contained in the case 53. The case 53 is provided with a detachable unit (not shown) that supports the ink containers 51. The four ink containers 51 are detachably supported by the detachable unit. Each ink container 51 has an ink bag serving as a liquid containing portion. An ink is sealed in the ink bag composed of a flexible sheet. In the liquid ejection system 1, when the ink within the ink bag is consumed, the ink container 51 is replaced with a new one.

The four ink containers 51 contain different types of inks. In the present embodiment, yellow (Y), magenta (M), cyan (C), and black (K) inks are contained in the different respective ink containers 51. In the following description, in the case where the four ink containers 51 are distinguished by the type of inks, the four ink containers 51 are individually described as the ink container 51Y, the ink container 51M, the ink container 51C, and the ink container 51K. The ink container 51Y has an ink bag in which the yellow ink is sealed. Similarly, the ink container 51M has an ink bag in which the magenta ink is sealed, the ink container 51C has an ink bag in which the cyan ink is sealed, and the ink container 51K has an ink bag in which the black ink is sealed.

Ink supply tubes 57 are connected to the respective ink bags of the ink containers 51 via the detachable unit (not shown). The ink supply tubes 57, which are an example of a flow passage member, are connected from the ink supply apparatus 4 to the relay device 9. The relay device 9 has a pump unit 59. The pump unit 59 pumps up the inks within the ink containers 51 installed in the ink supply apparatus 4. Then, the pump unit 59 feeds the inks pumped up from the ink containers 51 to the recording head 19 via respective ink supply tubes 61. Thus, the inks within the ink containers 51 are supplied from the ink supply apparatus 4 to the recording head 19 via the relay device 9. The inks supplied to the recording head 19 are ejected as ink droplets from nozzles (not shown) that are directed to the side of the recording medium P.

In the liquid ejection system 1 having the above-described configuration, driving of the conveyance motor 13 is controlled by the control unit 11, and the conveyance device 5 intermittently conveys the recording medium P in the direction of the Y-axis while making the recording medium P oppose the recording head 19. At this time, the control unit 11 controls driving of the carriage motor 45 to move the carriage 17 backward and forward along the X-axis, and at the same time controls driving of the recording head 19 to cause ink droplets to be ejected at predetermined positions. As a result of the above-described operation, dots are formed on the recording medium P, and thus recording onto this recording medium P based on recording information such as image data is performed.

Figure 2:
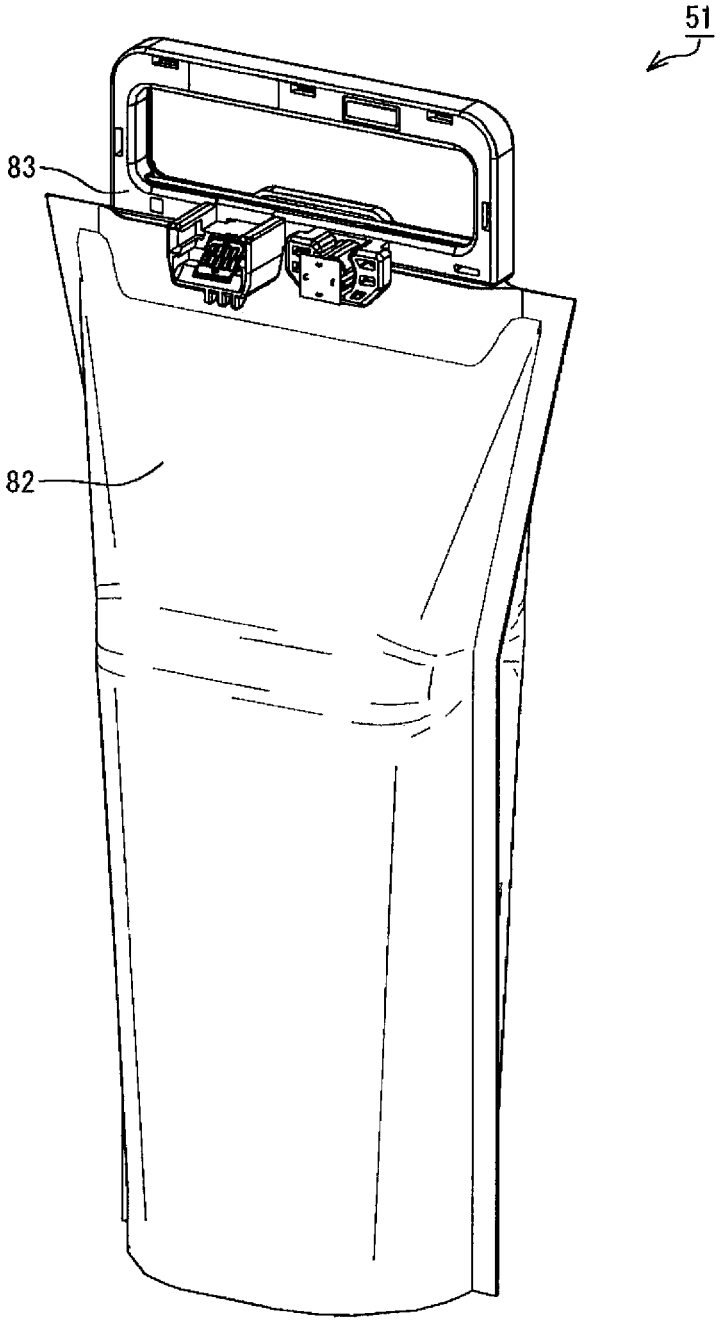
FIG. 2 is a perspective view showing an ink container according to the embodiment.

Each ink container 51 has, as shown in FIG. 2, the ink bag 82, which is an example of a liquid containing portion, and the flow passage unit 83. Here, in the present embodiment, the ink bag 82 of the ink container 51K of the four ink containers 51 is different from the ink bags 82 of the other ink containers 51. The volume of the ink bag 82 of the ink container 51K is larger than the volumes of the ink bags 82 of the other ink containers 51. Otherwise, the ink container 51K and the other ink containers 51 have the same configuration. The ink bag 82 of the ink container 51K and the ink bags 82 of the other ink containers 51 have the same configuration except that the volume is different. Thus, in the following description, the details are explained using the other ink containers 51 as an example, and explanation of the ink container 51K is omitted. It should be noted that in the case where the ink bag 82 of the ink container 51K is distinguished from the ink bags 82 of the other ink containers 51, the ink bag 82 of the ink container 51K is described as the ink bag 82K.

Figure 3:
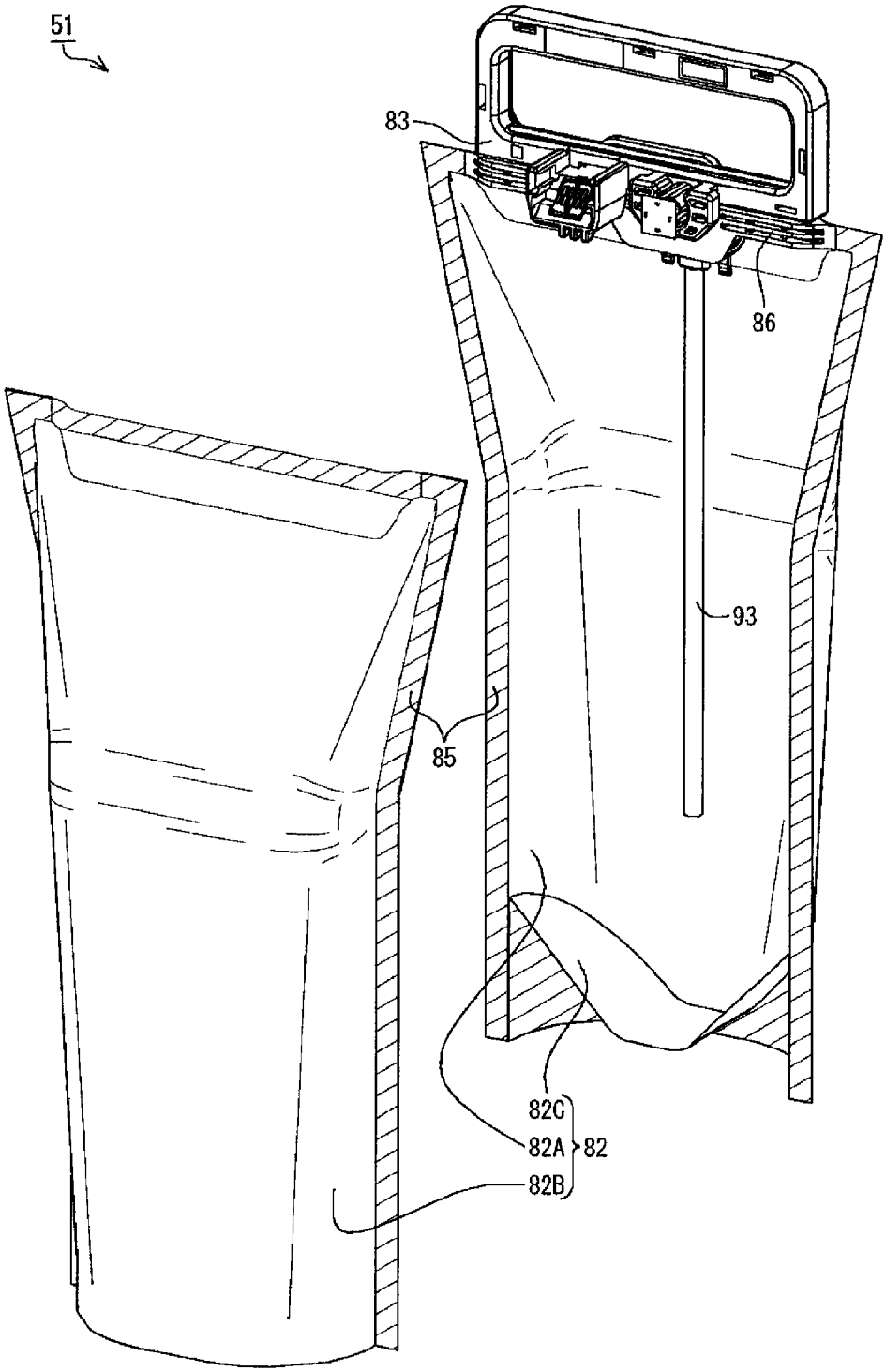
FIG. 3 is an exploded perspective view showing the ink container according to the embodiment.

The ink bag 82 has, as shown in FIG. 3, a flexible sheet member 82A, a flexible sheet member 82B, and a sheet member 82C. The sheet member 82A and the sheet member 82B are fusion-bonded to each other at their peripheral edge regions 85 in a state in which the two sheet members are laid on top of the other. The sheet member 82C is sandwiched by the sheet member 82A and the sheet member 82B. A peripheral edge of the sheet member 82C is fusion-bonded to the sheet member 82A and the sheet member 82B in a state in which this peripheral edge overlaps the peripheral edge regions 85. Thus, the ink bag 82 has a bag-shaped form in which the sheet member 82C constitutes a bottom portion. The ink is contained inside the ink bag 82. Therefore, the ink bag 82 has the function of an ink containing portion that contains an ink, which is an example of a liquid. It should be noted that in FIG. 3, the peripheral edge regions 85 are hatched in order to clarify the configuration. Moreover, FIG. 3 shows a state in which the sheet member 82C is cut at a position between the sheet member 82A and the sheet member 82B.

With regard to each of the materials for the sheet member 82A, the sheet member 82B, and the sheet member 82C, for example, polyethylene terephthalate (PET), nylon, polyethylene, or the like can be used. Moreover, a laminated structure obtained by laminating films composed of these materials may also be used. In such a laminated structure, for example, it is possible to use PET or nylon, which has excellent impact resistance, for an outer layer, and polyethylene, which has excellent ink resistance, for an inner layer. Furthermore, for example, a film having a layer on which aluminum or the like is deposited may also be used. Thus, the gas barrier properties can be increased.

The flow passage unit 83 is sandwiched by the sheet member 82A and the sheet member 82B in a portion of the respective peripheral edge regions 85. In a portion of the peripheral edge region 85, the flow passage unit 83 and the sheet member 82A are fusion-bonded to each other. Similarly, in a portion of the peripheral edge region 85, the flow passage unit 83 and the sheet member 82B are fusion-bonded to each other. Therefore, the portion of the peripheral edge regions 85 where the flow passage unit 83 is sandwiched by the sheet member 82A and the sheet member 82B serves as a joint portion between the ink bag 82 and the flow passage unit 83. The flow passage unit 83 is provided with a fusion-bonding portion 86. In a state in which the fusion-bonding portion 86 is sandwiched by the sheet member 82A and the sheet member 82B, the sheet member 82A and the sheet member 82B are individually fusion-bonded to the fusion-bonding portion 86. The ink bag 82 in which the sheet member 82C constitutes the bottom portion is configured by the sheet member 82A, the sheet member 82B, and the flow passage unit 83 being joined to one another.

Figure 4:
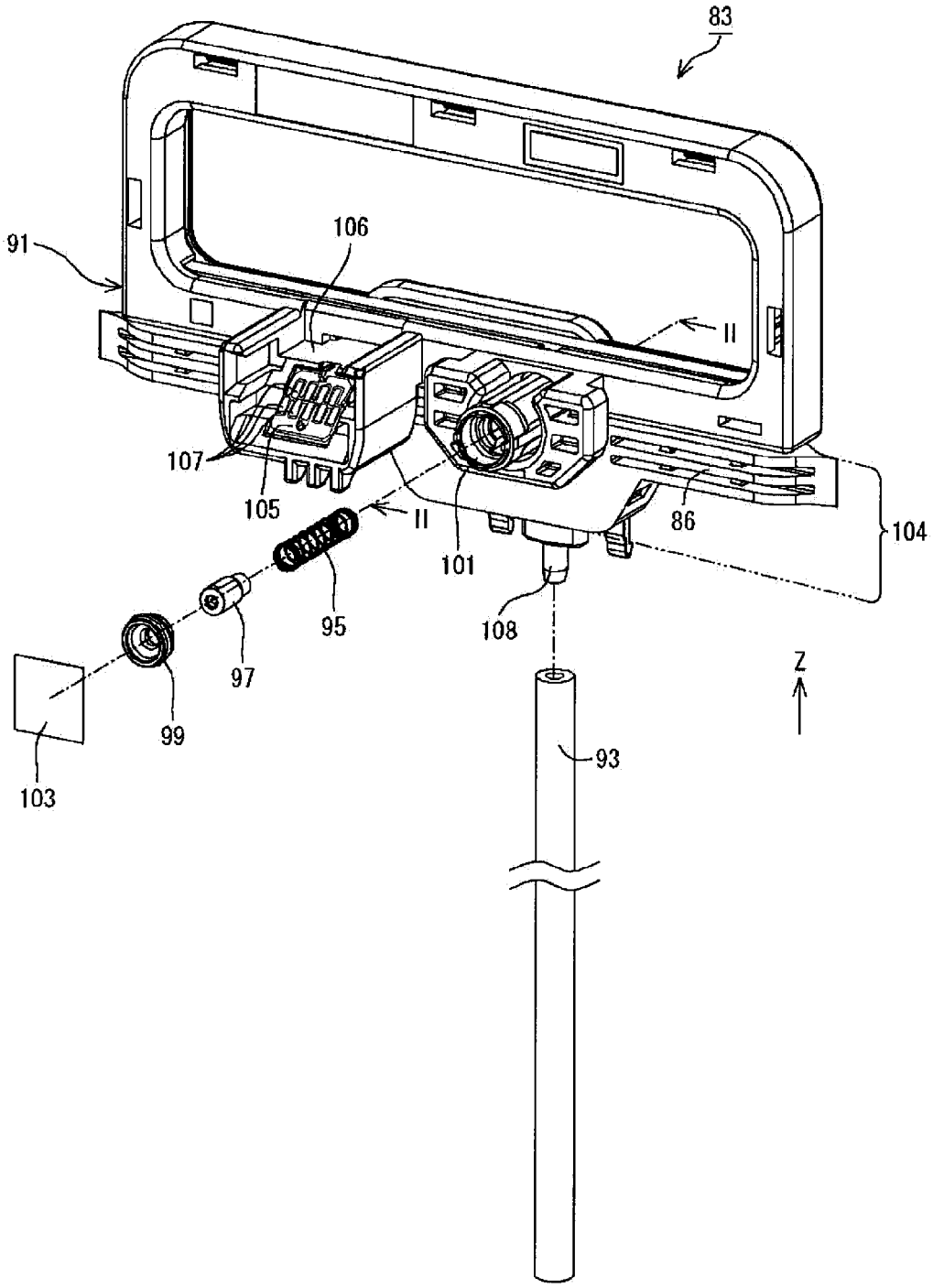
FIG. 4 is an exploded perspective view showing a flow passage unit according to the embodiment.

The flow passage unit 83 has, as shown in FIG. 4, a flow passage member 91 and a tube 93 as well as a spring 95, a plug (valve element) 97, and a packing (valve seat) 99, which constitute a valve. The flow passage member 91 is provided with a supply portion 101, which is an example of a liquid outlet portion. The interior of the ink bag 82 (FIG. 3) is in communication with the exterior thereof via the supply portion 101. The flow passage member 91 has the function of a liquid discharge portion through which the ink, which is an example of the liquid, is discharged from the interior of the ink bag 82 to the exterior thereof. The spring 95, the plug 97, and the packing 99 are contained in the supply portion 101 in that order. In a state before the ink container 51 is installed in the ink supply apparatus 4, the supply portion 101 is closed by a film 103. Thus, the interior of the ink bag 82 is kept in a sealed state.

In addition, the flow passage unit 83 is provided with a circuit board 105, which is an example of an electrical connection portion. The flow passage member 91 is provided with a board mounting portion 106. The board mounting portion 106 is provided on the side of the supply portion 101 in the flow passage member 91. That is to say, the supply portion 101 and the board mounting portion 106 are provided on the same side of the flow passage member 91. The circuit board 105 is provided in the board mounting portion 106. The circuit board 105 is provided with a plurality of terminal portions 107. The plurality of terminal portions 107 face a side opposite to the side of the flow passage member 91. A storage device (not shown) such as a non-volatile memory is provided on a side of the circuit board 105 that is opposite to the terminal portions 107. At least a portion of the plurality of terminal portions 107 is electrically connected to the storage device. In a state in which the ink container 51 is installed in the ink supply apparatus 4, at least a portion of the plurality of terminal portions 107 comes into contact with a contact mechanism (not shown) provided within the case 53 (FIG. 1). The contact mechanism is electrically connected to the control unit 11 via the flexible cable 31 (FIG. 1). Then, when electrical continuity is established between the contact mechanism and the storage device of the ink container 51 via the circuit board 105, various types of information can be transmitted between the control unit 11 and the storage device of the ink container 51.

The flow passage member 91 has a base portion 104. Side surfaces of the base portion 104 are set as the fusion-bonding portion 86. The flow passage member 91 is provided with an introduction port 108. The introduction port 108 is provided in the base portion 104 and extends along the Z-axis. The introduction port 108 protrudes from the base portion 104 in the direction of the negative Z-axis. The introduction port 108 is in communication with the interior of the ink bag 82, and the ink within the ink bag 82 is introduced into the supply portion 101 therethrough. It should be noted that the supply portion 101 extends in a direction that intersects the direction in which the introduction port 108 extends, that is, in the direction that intersects the Z-axis. The supply portion 101 also is provided in the base portion 104 and protrudes from the base portion 104 in the direction that intersects the direction of the Z-axis. The tube 93 is connected to the introduction port 108. Moreover, as shown in FIG. 3, the tube 93 is contained within the ink bag 82. The tube 93 allows an introduction passage to the introduction port 108 to be extended to the inner side of the ink bag 82.

Figure 5:
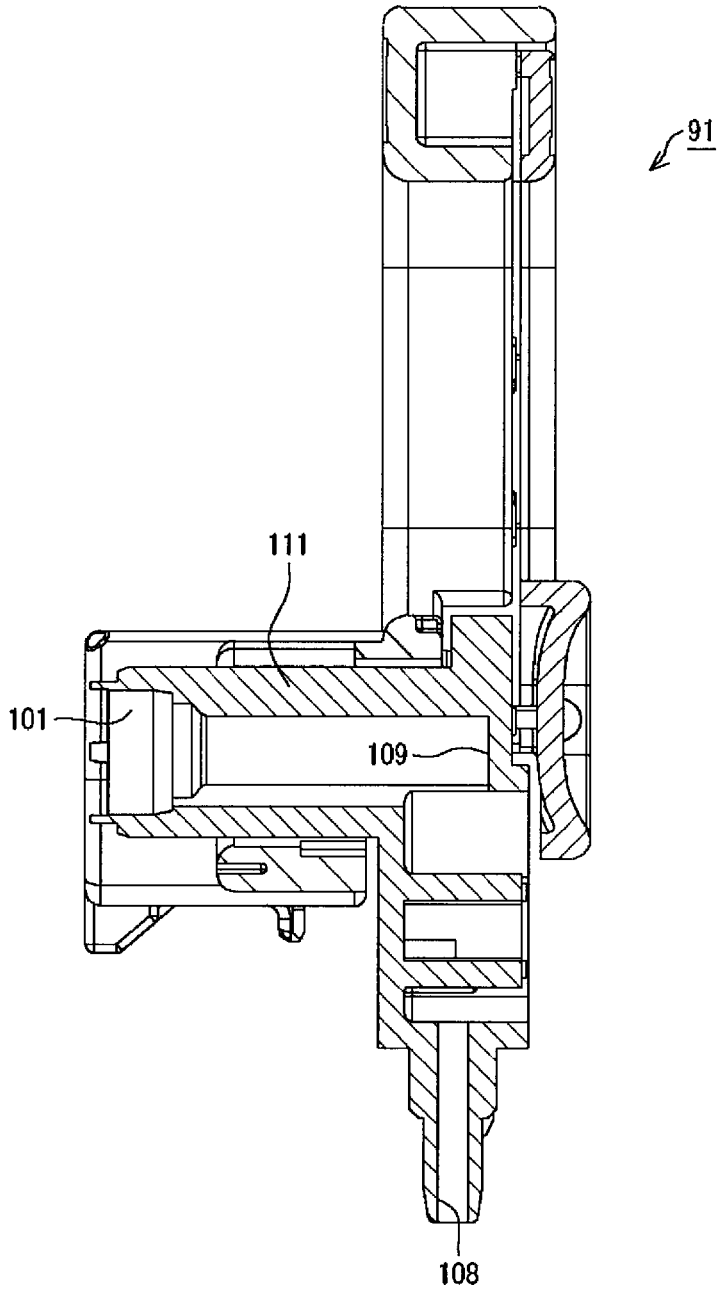
FIG. 5 is a cross-sectional view of a flow passage member according to the embodiment taken along line II-II in FIG. 4.
Figure 6:
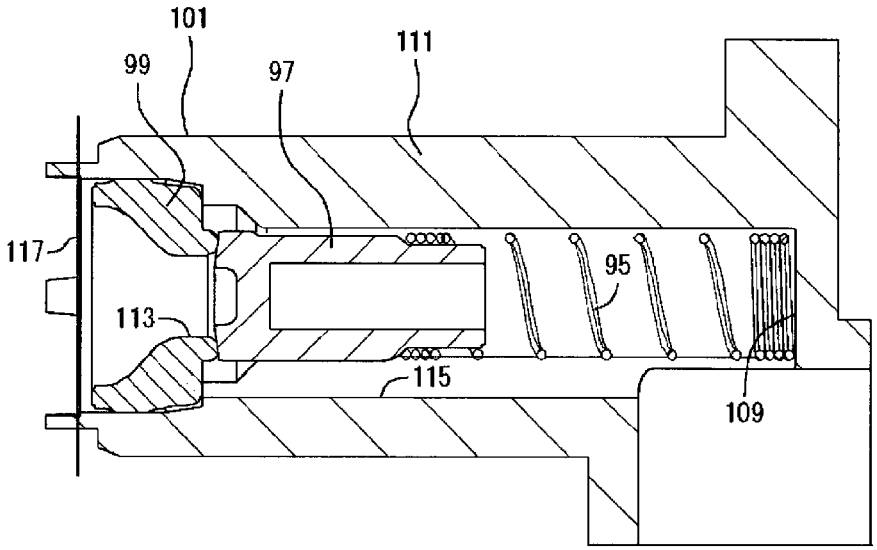
FIG. 6 is an enlarged cross-sectional view of the flow passage unit according to the embodiment taken along line II-II in FIG. 4.

As shown in FIG. 5, inside the flow passage member 91, the supply portion 101 is in communication with the introduction port 108. The supply portion 101 has a bottom portion 109 and a side wall 111. The side wall 111 surrounds the bottom portion 109. A region surrounded by the side wall 111 has the function of a supply port through which the ink within the ink bag 82 is supplied to the outside. As shown in FIG. 6, the spring 95, the plug 97, and the packing 99 are contained inside the supply portion 101. The spring 95 is sandwiched by the bottom portion 109 of the supply portion 101 and the plug 97. The plug 97 is sandwiched by the spring 95 and the packing 99. Therefore, the plug 97 is energized by the spring 95 toward the packing 99.

The packing 99 is composed of, for example, an elastic body such as rubber, elastomer, or the like. The packing 99 is press fitted in the supply portion 101. The packing 99 has an opening 113. The plug 97 is energized toward the packing 99 in a state in which the plug 97 overlaps the opening 113 of the packing 99. Thus, the opening 113 of the packing 99 is closed by the plug 97. A clearance is kept between the plug 97 and the supply portion 101. Also, a clearance is kept between the spring 95 and the supply portion 101. Thus, the plug 97 and the spring 95 can be individually displaced within the supply portion 101 in the direction in which the supply portion 101 extends.

Here, a groove 115 is provided inside the supply portion 101. The groove 115 extends from the side of a terminating end 117 of the supply portion 101 toward the bottom portion 109 in the direction in which the supply portion 101 extends. The groove 115 extends from the bottom portion 109 to the packing 99 beyond the spring 95. The groove 115 is provided so as to be recessed from an inner wall toward an outer wall of the supply portion 101. Therefore, in a state in which the plug 97 is contained within the supply portion 101, a space that is surrounded by the plug 97 and the groove 115 can be used as a flow passage for the ink.

Figure 7:
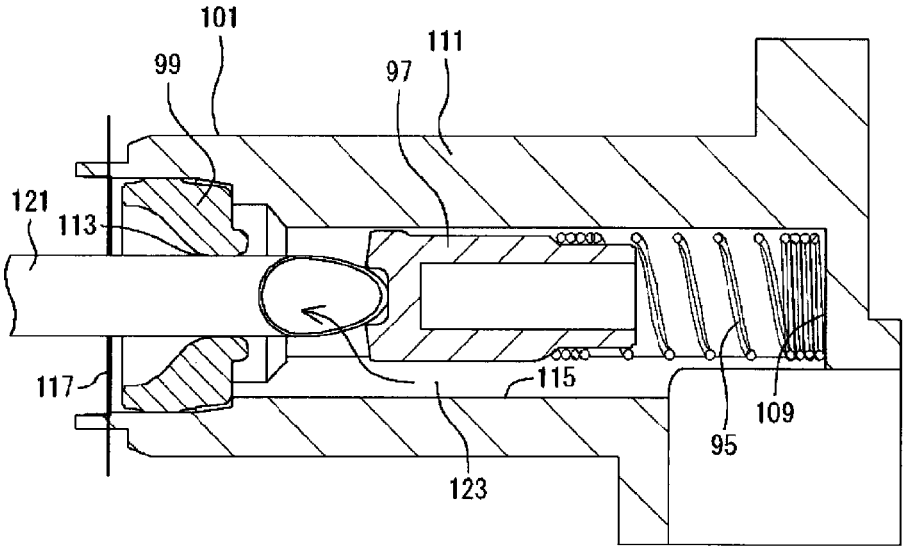
FIG. 7 is an enlarged cross-sectional view of the flow passage unit according to the embodiment taken along line II-II in FIG. 4.

When the ink container 51 is installed in the ink supply apparatus 4 (FIG. 1), as shown in FIG. 7, a supply needle 121 is inserted into the opening 113 of the packing 99. At this time, the plug 97 is pushed by the supply needle 121 and displaced toward the bottom portion 109. The supply needle 121 is formed in a hollow shape. Also, the supply needle 121 is in communication with the ink supply tube 57. Thus, as indicated by the arrow in FIG. 7, the ink can be supplied to the ink supply tube 57 (FIG. 1) from a flow passage 123 surrounded by the groove 115 and the plug 97 via the supply needle 121. It should be noted that the supply needle 121 is provided within the case 53 of the ink supply apparatus 4.

Figure 8:
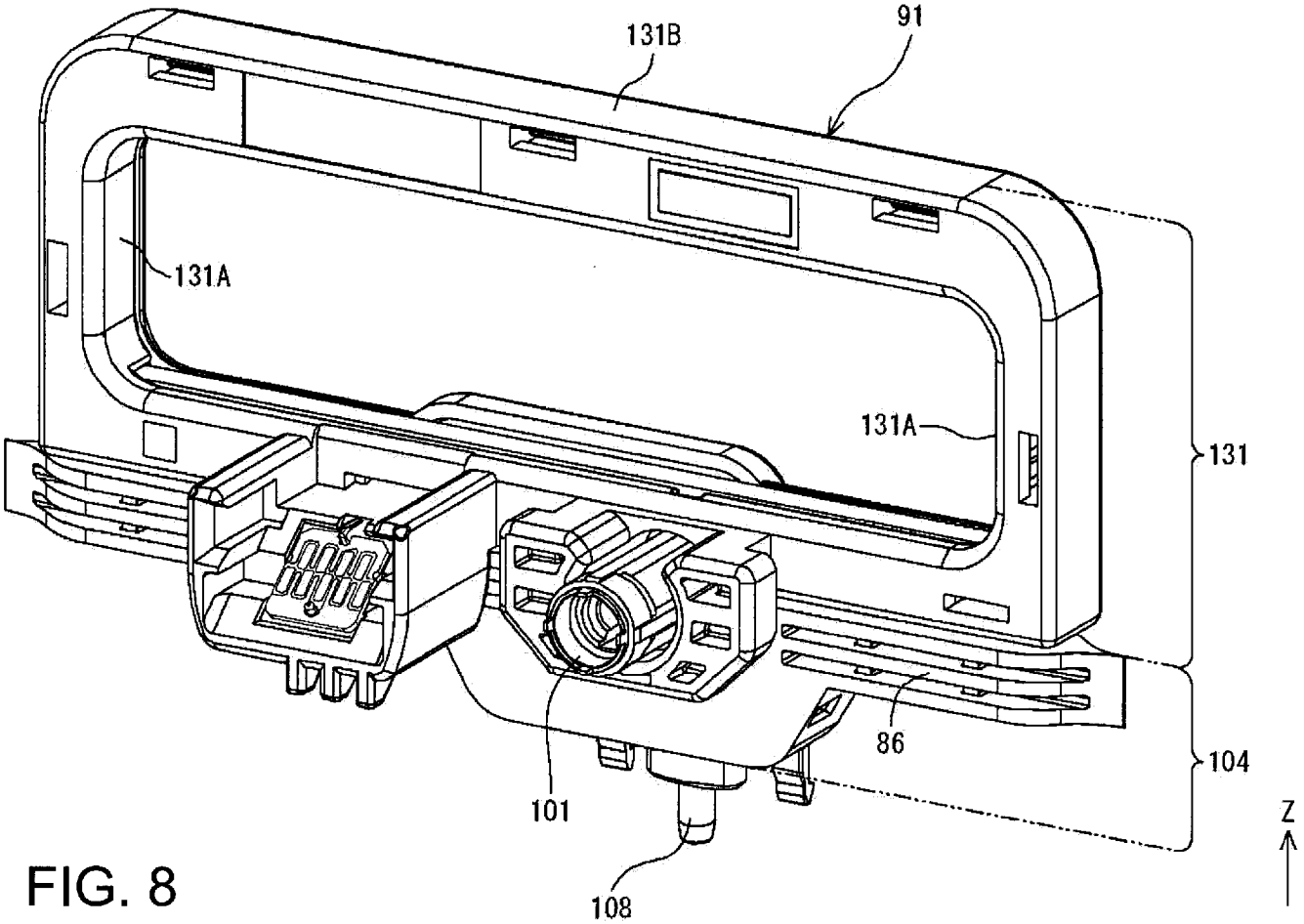
FIG. 8 is a perspective view showing the flow passage member according to the embodiment.

As shown in FIG. 8, the flow passage member 91 has a handle portion 131. The handle portion 131 is provided on the base portion 104. The handle portion 131 protrudes from the base portion 104 in the positive direction of the Z-axis, that is, from the base portion 104 to a side that is opposite to the side of the introduction port 108 of the base portion 104 or, in other words, to the side of the ink bag 82. Thus, the handle portion 131 protrudes from the ink bag 82 to the outside of the ink bag 82. The handle portion 131 extends in the direction in which the base portion 104 extends. The handle portion 131 has two leg portions 131A and a grip portion 131B. Each of the two leg portions 131A is provided on the base portion 104 and extends from the base portion 104 in the positive direction of the Z-axis. The two leg portions 131A are individually connected to the base portion 104 and therefore may also be called the connection regions.

The two leg portions 131A are spaced apart from each other in the direction in which the base portion 104 extends. The grip portion 131B is provided on the positive side with respect to the two leg portions 131A in the direction of the Z-axis, that is, on a side of the two leg portions 131A that is opposite to the side of the base portion 104. The grip portion 131B extends in the direction in which the base portion 104 extends. The two leg portions 131A are individually continuous with the grip portion 131B. The above-described configuration makes it possible for a worker to insert the fingers into a space between the grip portion 131B and the base portion 104 and hold the grip portion 131B. Then, the worker can carry the ink container 51 in the hand while holding the grip portion 131B.

Figure 9:
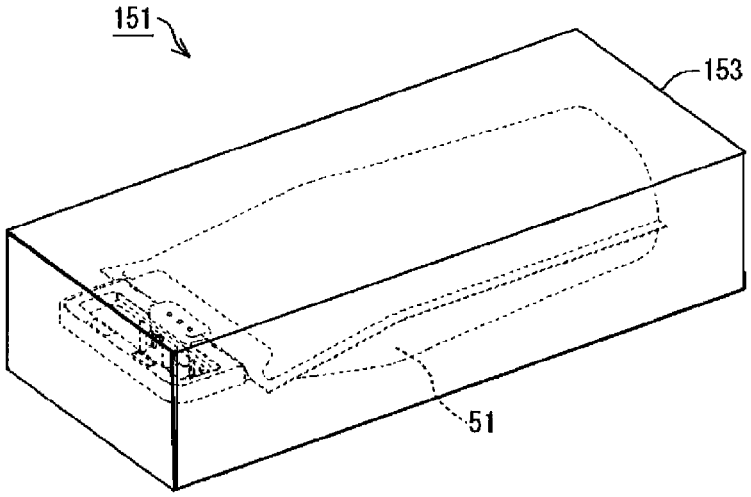
FIG. 9 is a perspective view showing a package according to the embodiment.

The form of distribution of the ink container 51 according to the present embodiment will be described. As shown in FIG. 9, the ink container 51 is distributed in the form of a package 151, which is an example of a packaging body. That is to say, the package 151 is an example of the form in which the ink container 51 is sold. The package 151 has a packing box 153 and the ink container 51. The packing box 153 is an example of an exterior box.

Figure 10:
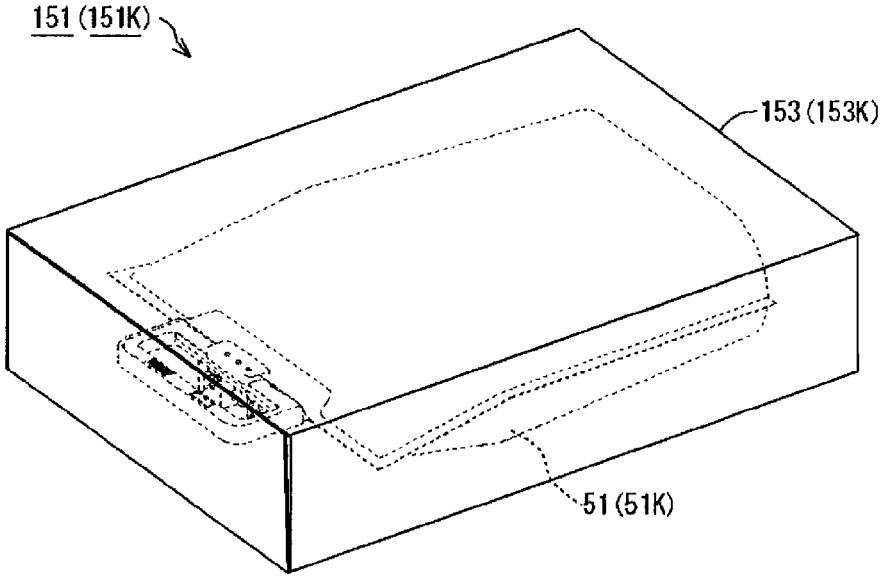
FIG. 10 is a perspective view showing a package according to the embodiment.

The package 151 of the ink container 51K also has, as shown in the FIG. 10, the packing box 153 and the ink container 51 (51K), as in the case of the package 151 of the ink container 51. In the following description, in the case where the package 151 of the ink container 51K is distinguished from the package 151 of the ink container 51, the package 151 of the ink container 51K is described as the package 151K. In this case, the packing box 153 of the package 151K is described as the packing box 153K.

In the package 151, the ink container 51 is contained in the packing box 153. In order to clarify the configuration, FIGS. 9 and 10 show a state in which the ink container 51 contained inside the packing box 153 is seen through from the outside of the packing box 153. It should be noted that various materials such as paper, synthetic resins, metal, and the like can be used as the material for the packing box 153.

Figure 11:
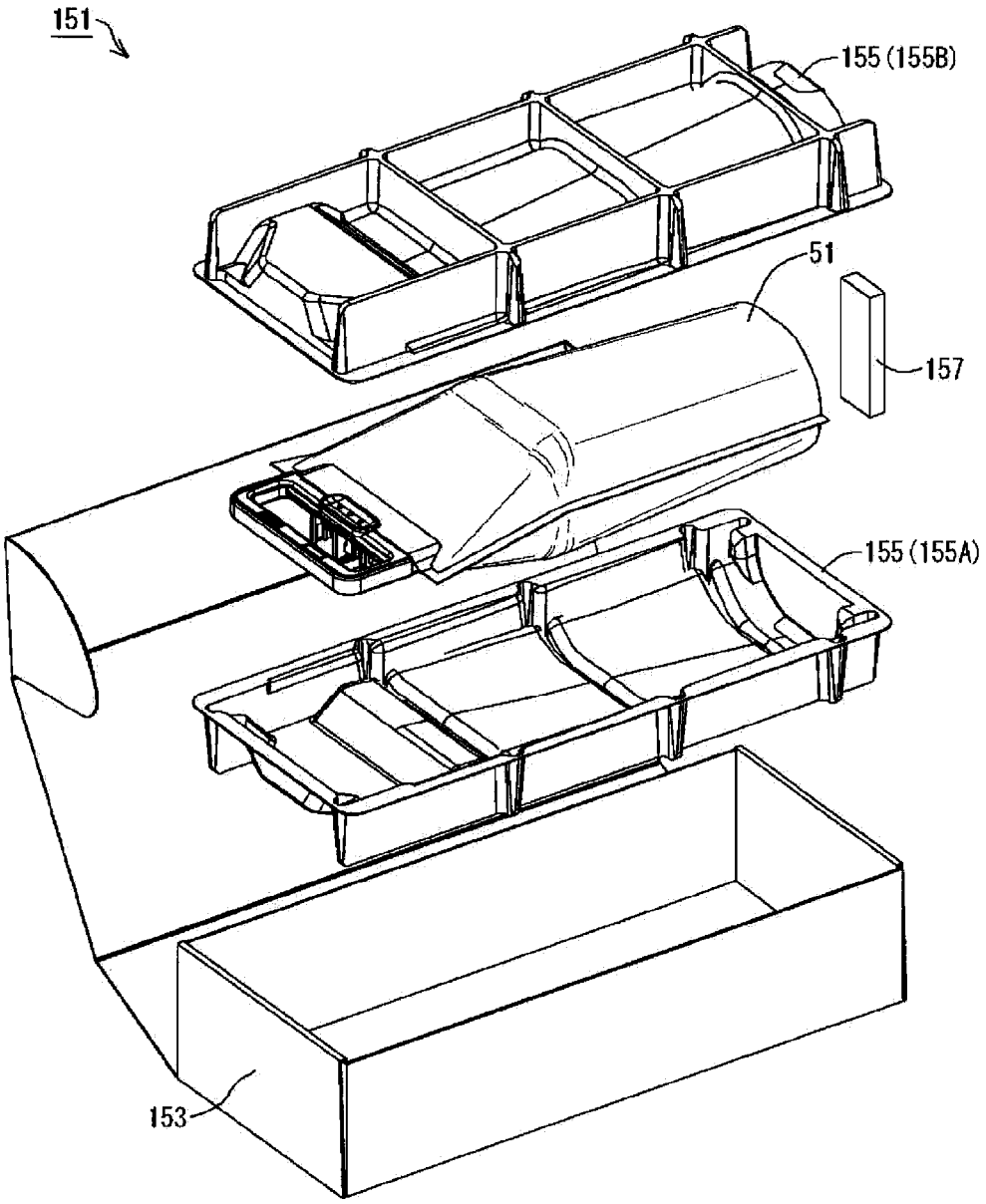
FIG. 11 is an exploded perspective view showing the package according to the embodiment.
Figure 12:
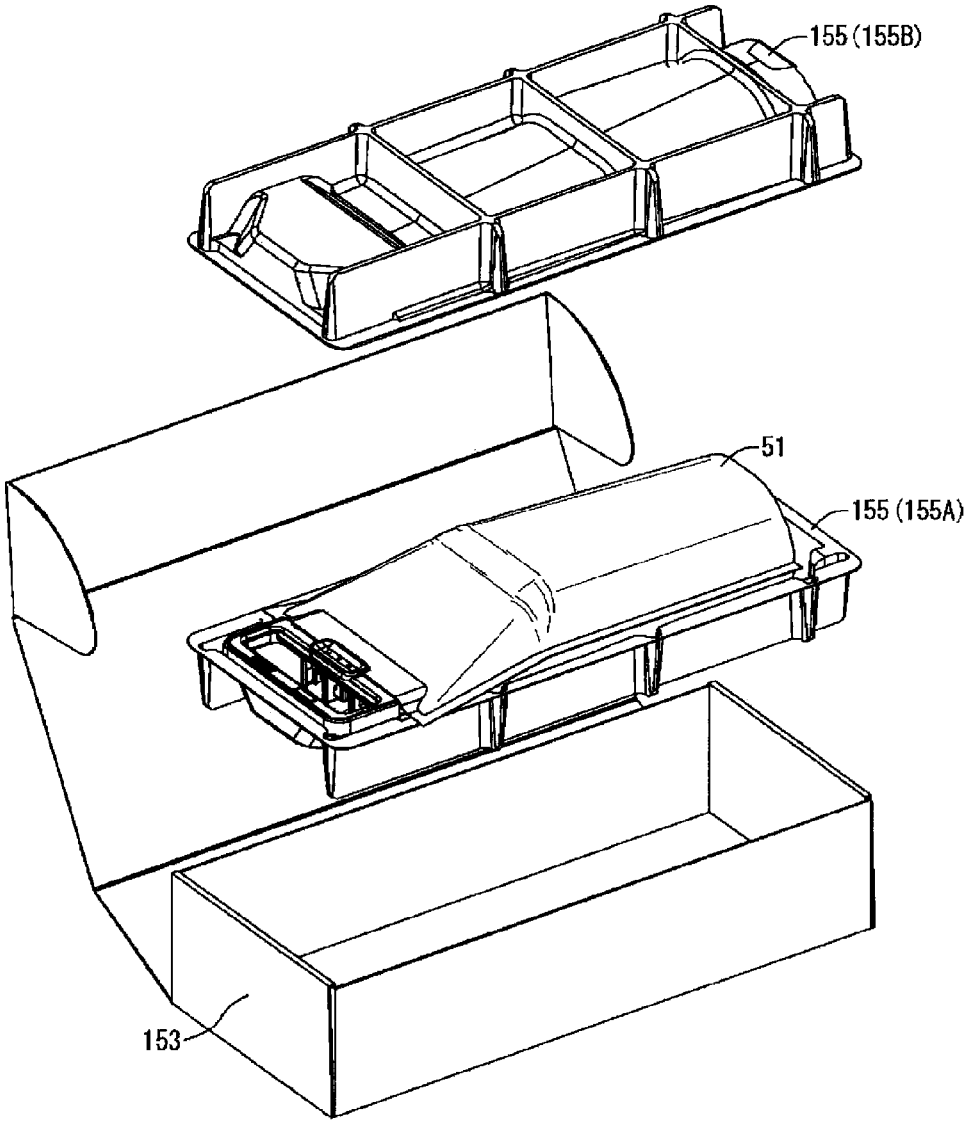
FIG. 12 is an exploded perspective view showing the package according to the embodiment.

Furthermore, as shown in FIG. 11, the package 151 has a plurality of packaging trays 155 and a spacer 157. In the present embodiment, the package 151 has two packaging trays 155. The two packaging trays 155 have the same structure. In the following description, in the case where the two packaging trays 155 are distinguished from each other, the two packaging trays 155 are described as the packaging tray 155A and the packaging tray 155B, respectively. As shown in FIG. 12, the packaging trays 155 are configured to be able to receive the ink container 51. The ink container 51 is contained in the packing box 153 together with the two packaging trays 155 in a state in which the ink container 51 is sandwiched by the two packaging trays 155.

Figure 13:
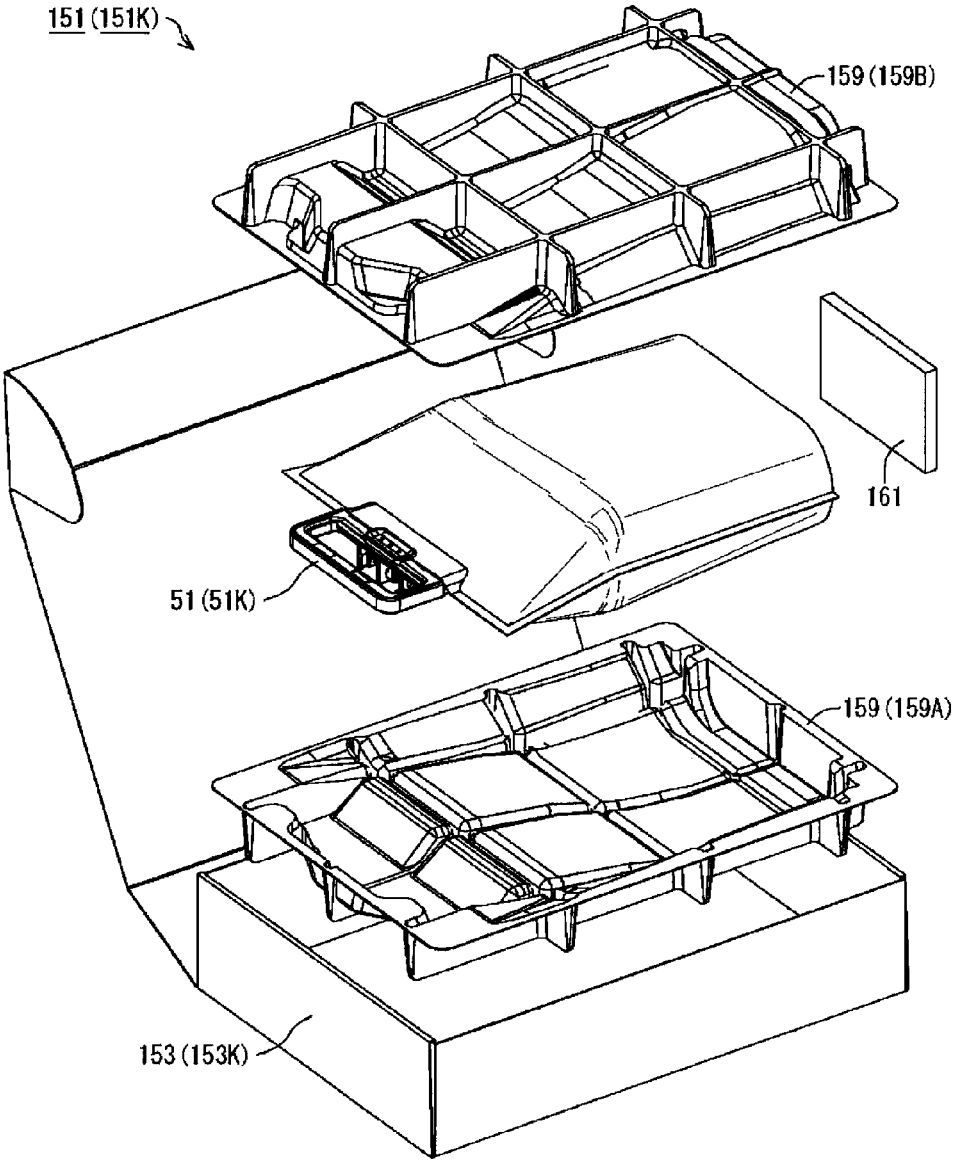
FIG. 13 is an exploded perspective view showing the package according to the embodiment.
Figure 14:
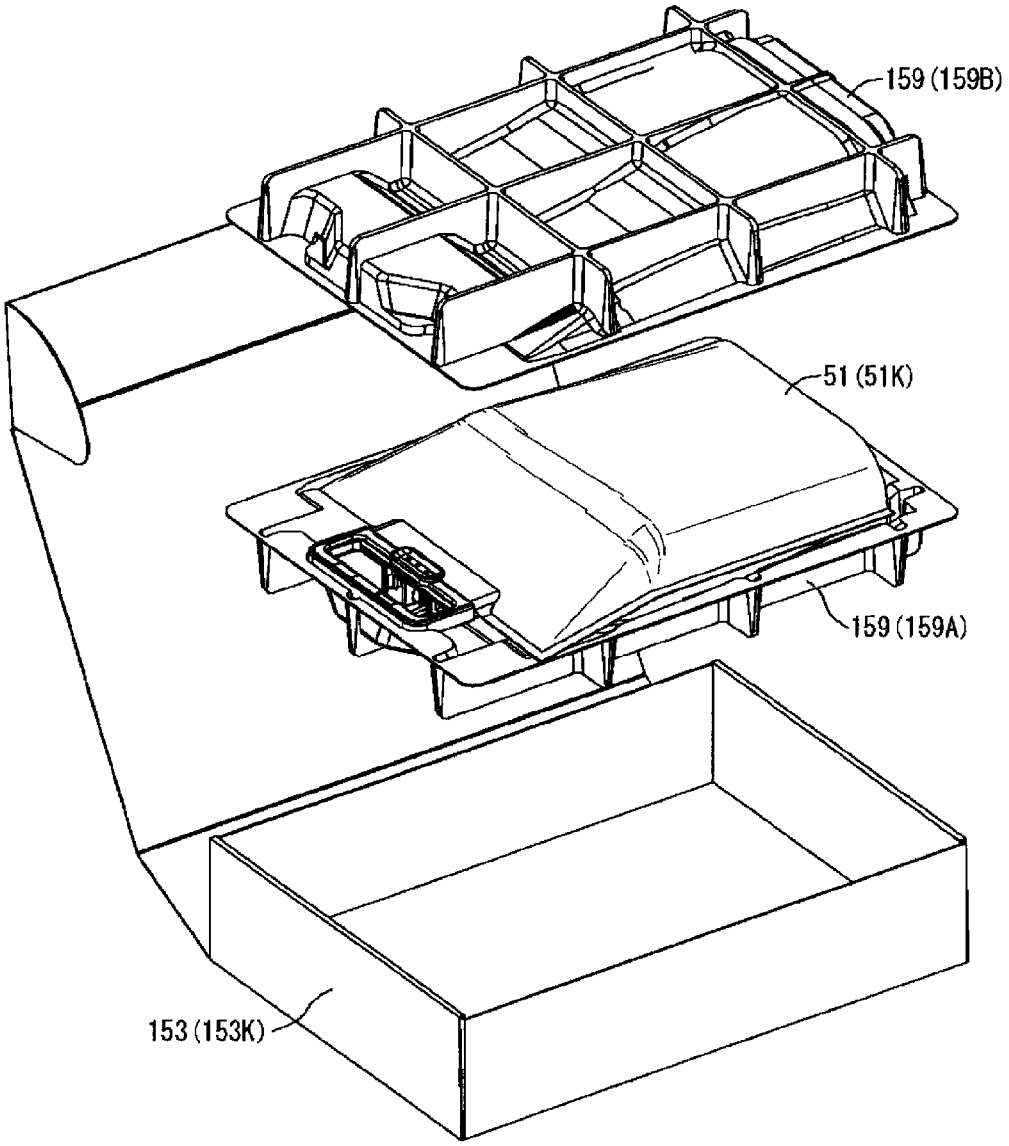
FIG. 14 is an exploded perspective view showing the package according to the embodiment.

Similarly, as shown in FIG. 13, the package 151K has a plurality of packaging trays 159 and a spacer 161. In the present embodiment, the package 151K has two packaging trays 159. The two packaging trays 159 have the same structure. In the following description, in the case where the two packaging trays 159 are distinguished from each other, the two packaging trays 159 are described as the packaging tray 159A and the packaging tray 159B, respectively. As shown in FIG. 14, the packaging trays 159 are configured to be able to receive the ink container 51K. The ink container 51K is contained in the packing box 153K together with the two packaging trays 159 in a state in which the ink container 51K is sandwiched by the two packaging trays 159.

Figure 15:
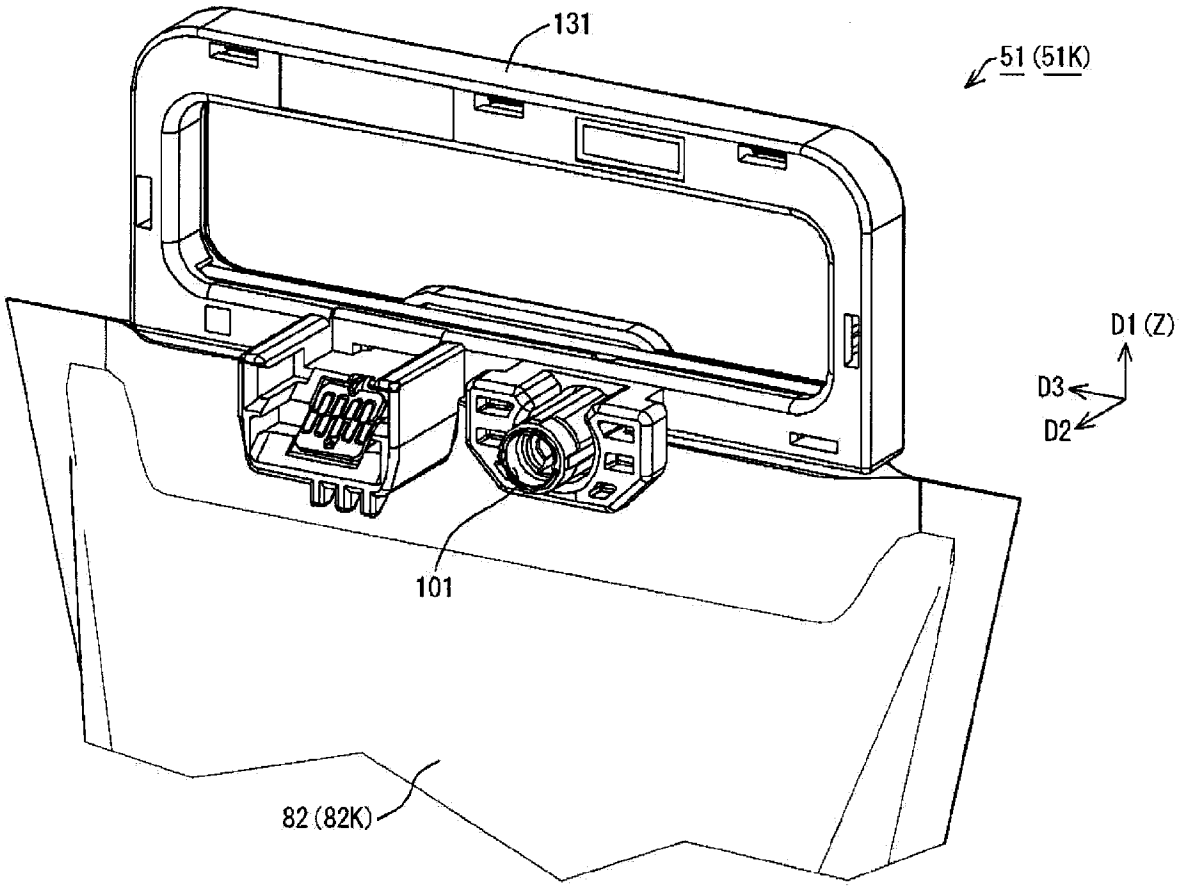
FIG. 15 is a perspective view showing the ink container according to the embodiment.

Here, directions with respect to the ink container 51 will be defined. As shown in FIG. 15, in the ink container 51, the handle portion 131 protrudes from the ink bag 82 to the outside of the ink bag 82. With respect to the ink container 51, the direction in which the handle portion 131 protrudes from the ink bag 82 is defined as a first direction D1. In the ink container 51, the handle portion 131 is provided on one end side of the ink bag 82. Also, the supply portion 101 is located on the side of the ink bag 82 of the handle portion 131. The supply portion 101 protrudes in a direction that intersects the first direction D1. With respect to the ink container 51, the direction in which the supply portion 101 protrudes is defined as a second direction D2. An end surface of the supply portion 101 is oriented in the second direction D2. Moreover, with respect to the ink container 51, a direction that intersects both of the first direction D1 and the second direction D2 is defined as a third direction D3. It should be noted that in the present embodiment, the first direction D1, the second direction D2, and the third direction D3 are orthogonal to one another. Moreover, in a state in which the ink container 51 is installed in the ink supply apparatus 4, the first direction D1 coincides with the direction of the Z-axis.

Figure 16:
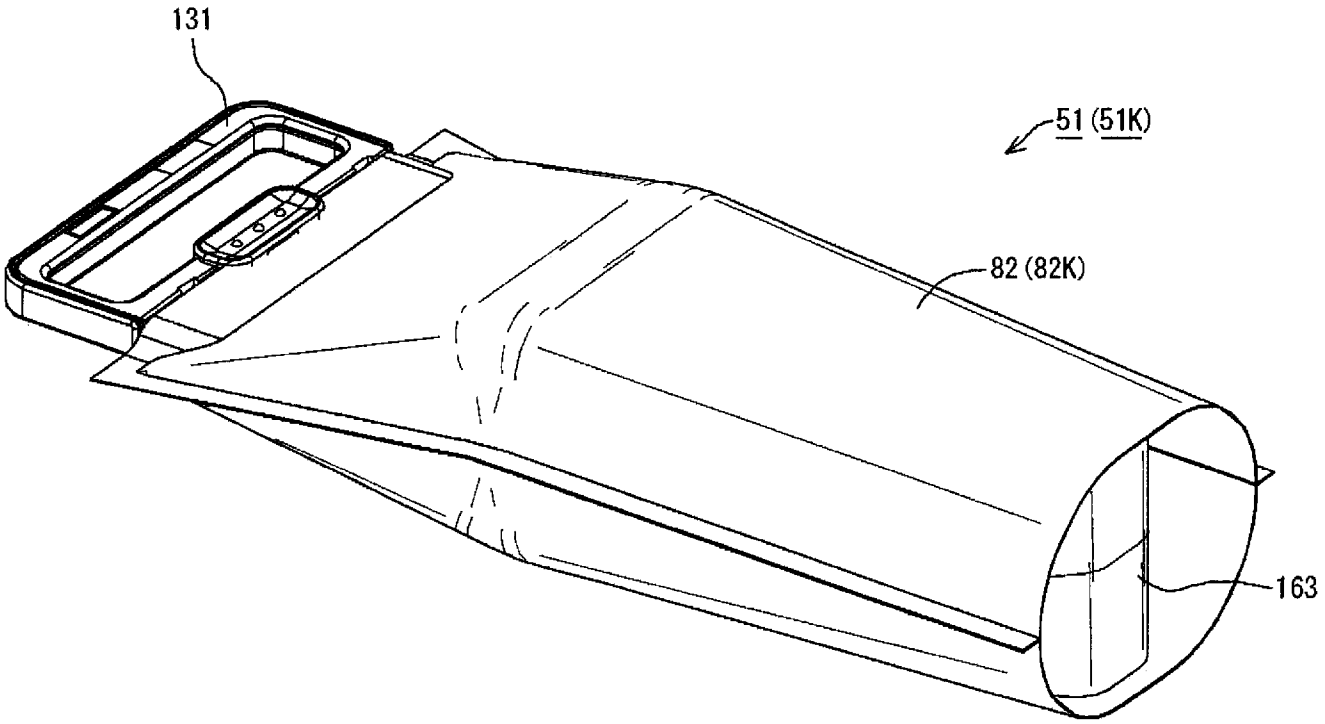
FIG. 16 is a perspective view showing the ink container according to the embodiment.
Figure 17:
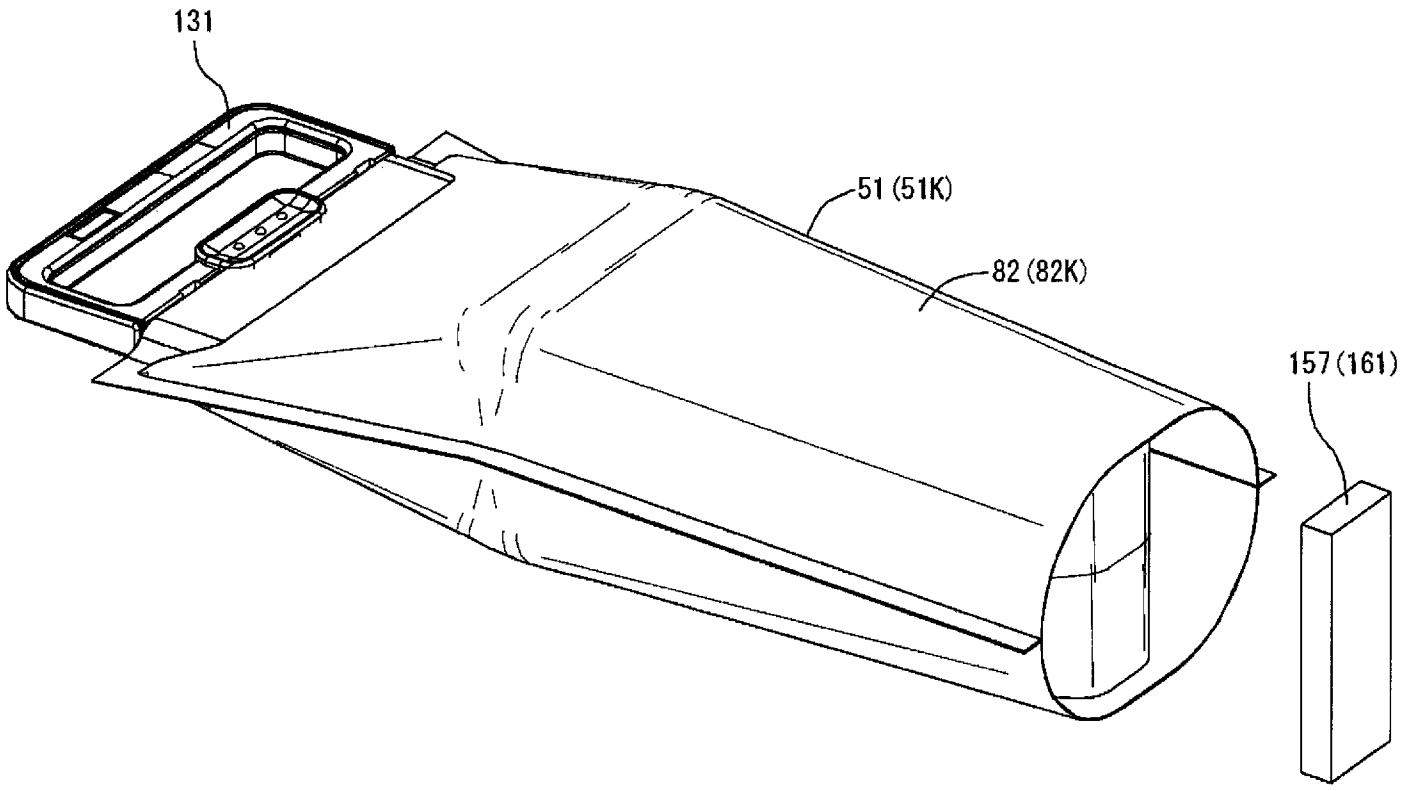
FIG. 17 is a perspective view showing the ink container and a spacer according to the embodiment.
Figure 18:
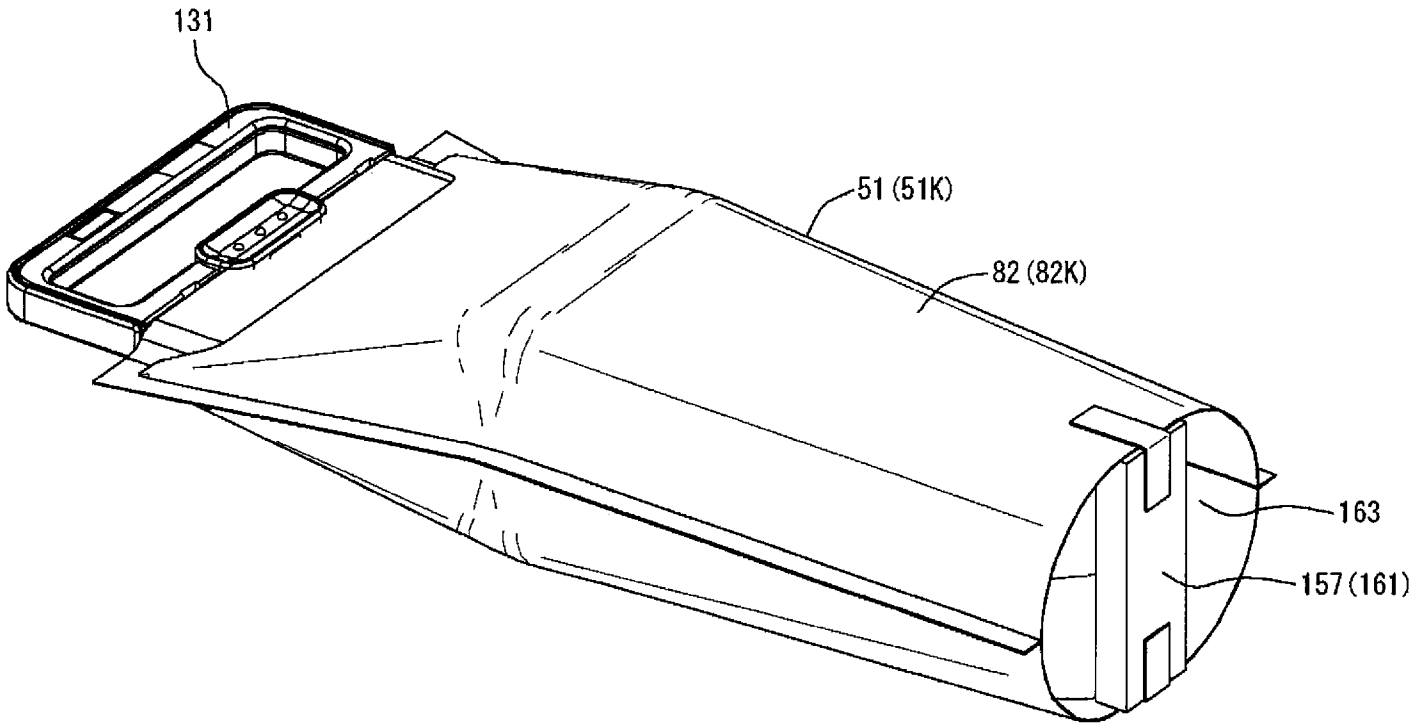
FIG. 18 is a perspective view showing the ink container and the spacer according to the embodiment.

In the ink container 51, as shown in FIG. 16, a gusset portion 163 is provided in an end portion of the ink bag 82 on a side opposite to the side of the handle portion 131. In a state in which the ink container 51 is installed in the ink supply apparatus 4, the gusset portion 163 corresponds to the bottom portion of the ink bag 82. The spacer 157 and the spacer 161 each have a plate shape, as shown in FIG. 17. Various materials such as paper, wood, synthetic resins, metal, and the like can be used as the material for the spacer 157 and the spacer 161. As shown in FIG. 18, the spacer 157 and the spacer 161 are each inserted into the gusset portion 163 of the ink bag 82 and fixed to the ink bag 82 with tape.

Thus, the gusset portion 163 of the ink bag 82 is maintained in an expanded state by the spacer 157 or the spacer 161. The spacer 157 or the spacer 161 inserted into the gusset portion 163 restricts the deformation of the gusset portion 163. Thus, the risk of fatigue failure of the sheet member 82C and the peripheral edge regions 85 (FIG. 3) due to repeated deformation of the gusset portion 163 can be kept low. The ink container 51 is contained in the packing box 153 via the packaging trays 155 or the packaging trays 159 in a state in which the spacer 157 or the spacer 161 is inserted therein.

Figure 19:
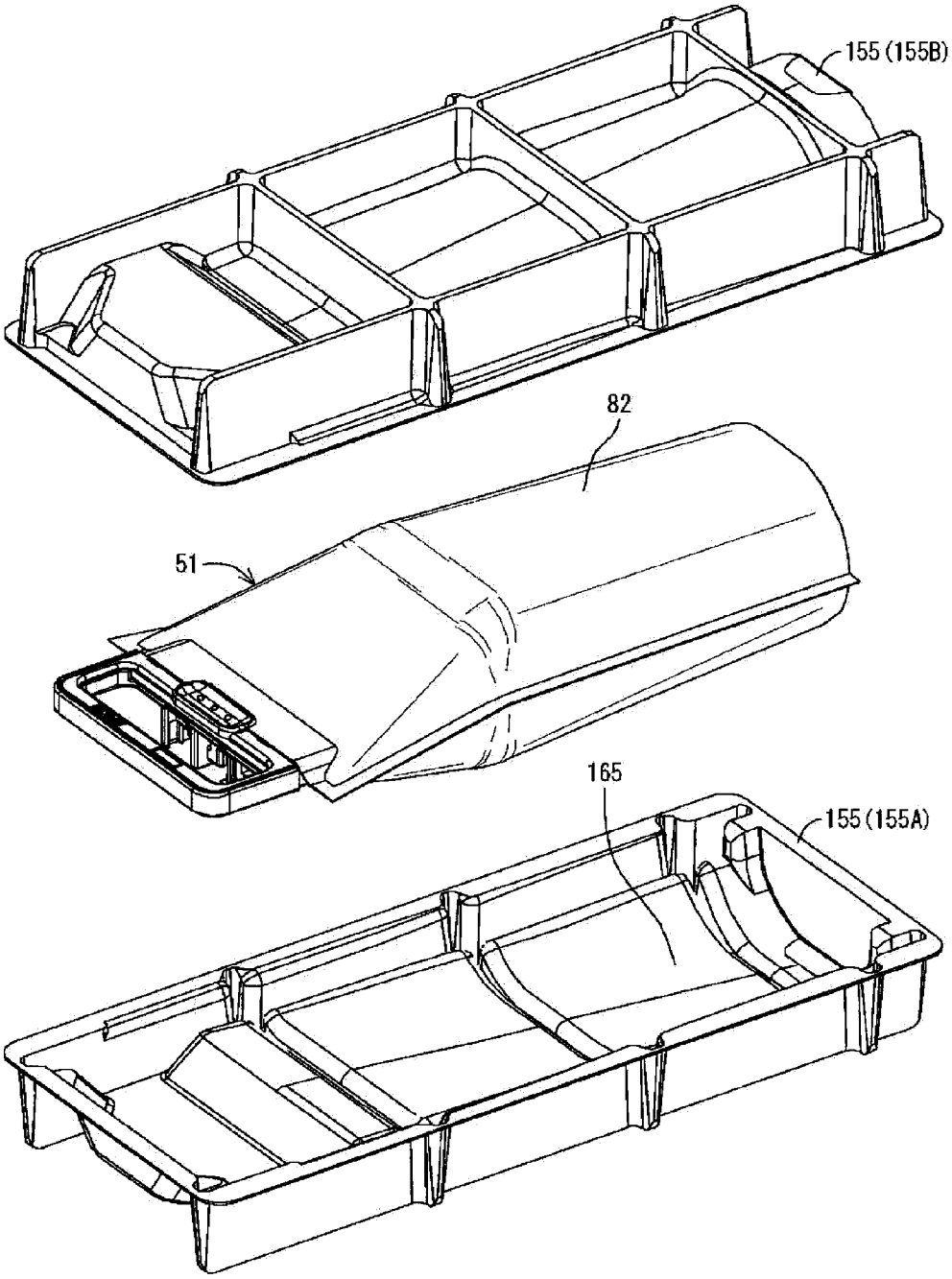
FIG. 19 is a perspective view showing the ink container and packaging trays according to the embodiment.
Figure 20:
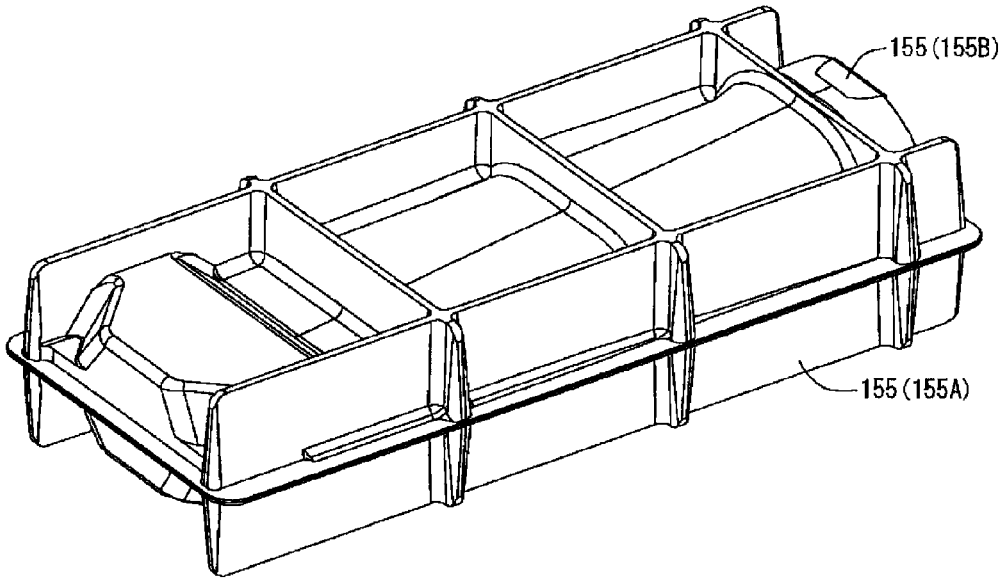
FIG. 20 is a perspective view showing the packaging trays according to the embodiment.

As shown in FIG. 19, the packaging trays 155 have the shape of a container. A recess 165 is formed in each packaging tray 155. The recess 165 is configured to be able to receive the ink container 51. Thus, the packaging tray 155 is configured such that the ink container 51 can be placed along the recess 165. When the ink container 51 is placed on the packaging tray 155, the shape of the ink bag 82 conforms to the shape of the recess 165 of the packaging tray 155. When the ink container 51 is placed on the packaging tray 155, the ink container 51 protrudes from the recess 165 of the packaging tray 155 (FIG. 12). However, when the ink container 51 is sandwiched by the two packaging trays 155, the ink container 51 is contained within a space surrounded by the two packaging trays 155, as shown in FIG. 20.

Figure 21:
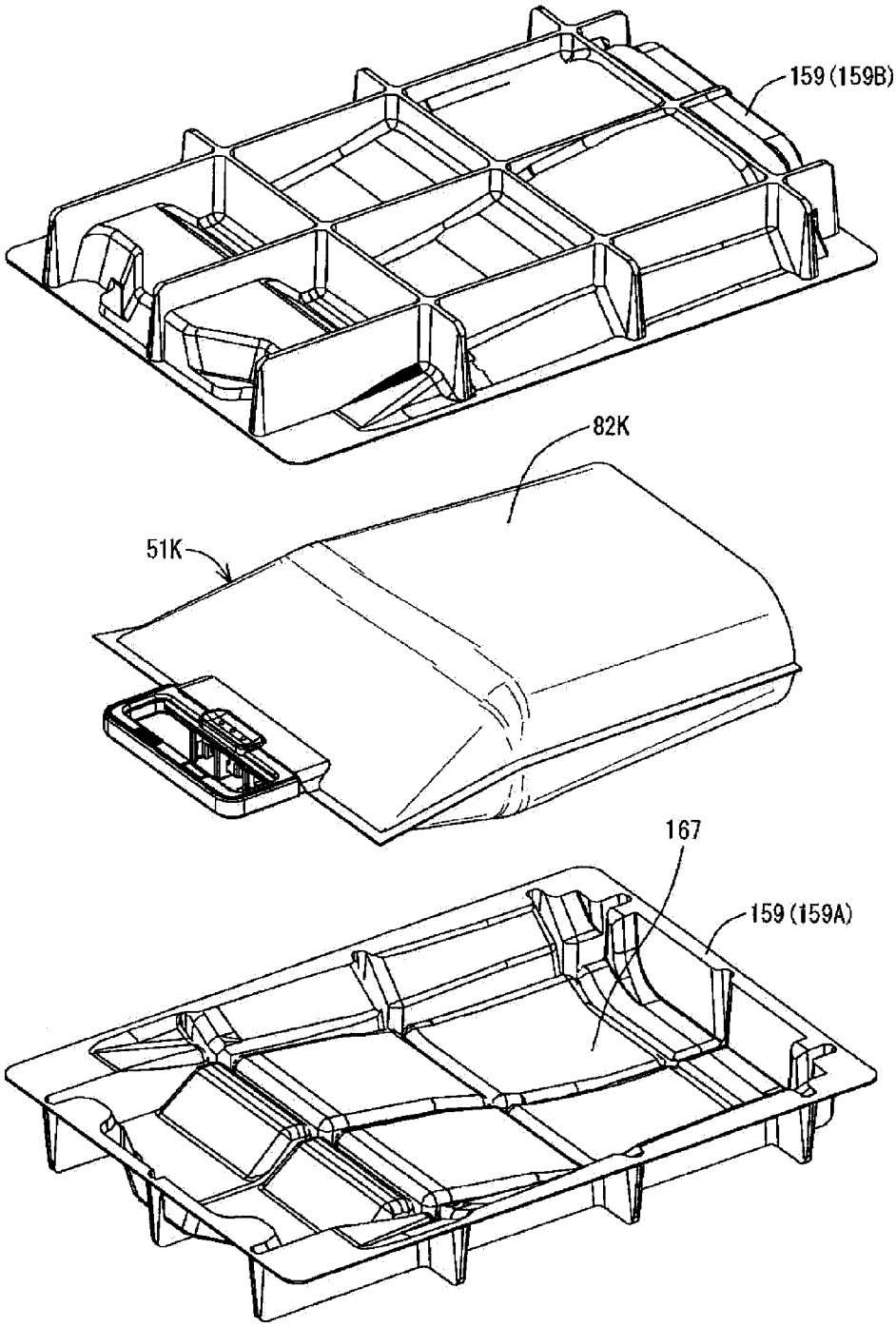
FIG. 21 is a perspective view showing an ink container and packaging trays according to the embodiment.
Figure 22:
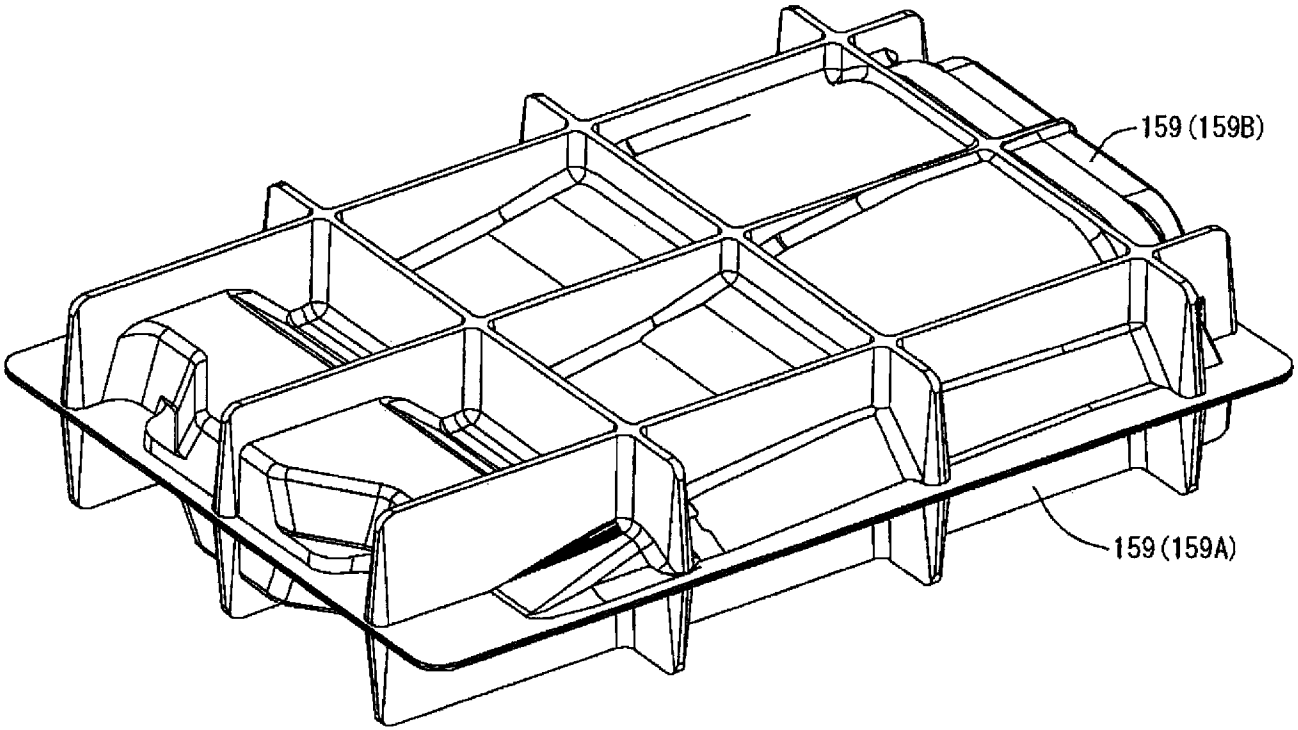
FIG. 22 is a perspective view showing the packaging trays according to the embodiment.

As shown in FIG. 21, the packaging trays 159 have the shape of a container. A recess 167 is formed in each packaging tray 159. The recess 167 is configured to be able to receive the ink container 51K. Thus, the packaging tray 159 is configured such that the ink container 51K can be placed along the recess 167. When the ink container 51K is placed on the packaging tray 159, the shape of the ink bag 82K conforms to the shape of the recess 167 of the packaging tray 159. When the ink container 51K is placed on the packaging tray 159, the ink container 51K protrudes from the recess 167 of the packaging tray 159 (FIG. 14). However, when the ink container 51K is sandwiched by the two packaging trays 159, the ink container 51K is contained within a space surrounded by the two packaging trays 159, as shown in FIG. 22.

Various materials such as paper, wood, synthetic resins, metal, and the like can be used as the material for the packaging trays 155 and the packaging trays 159. In the present embodiment, the packaging trays 155 and the packaging trays 159 are individually formed by shaping a synthetic resin. For example, injection molding, vacuum forming, blow molding, and the like can be used as the method for forming the packaging trays 155 and the packaging trays 159.

Figure 23:
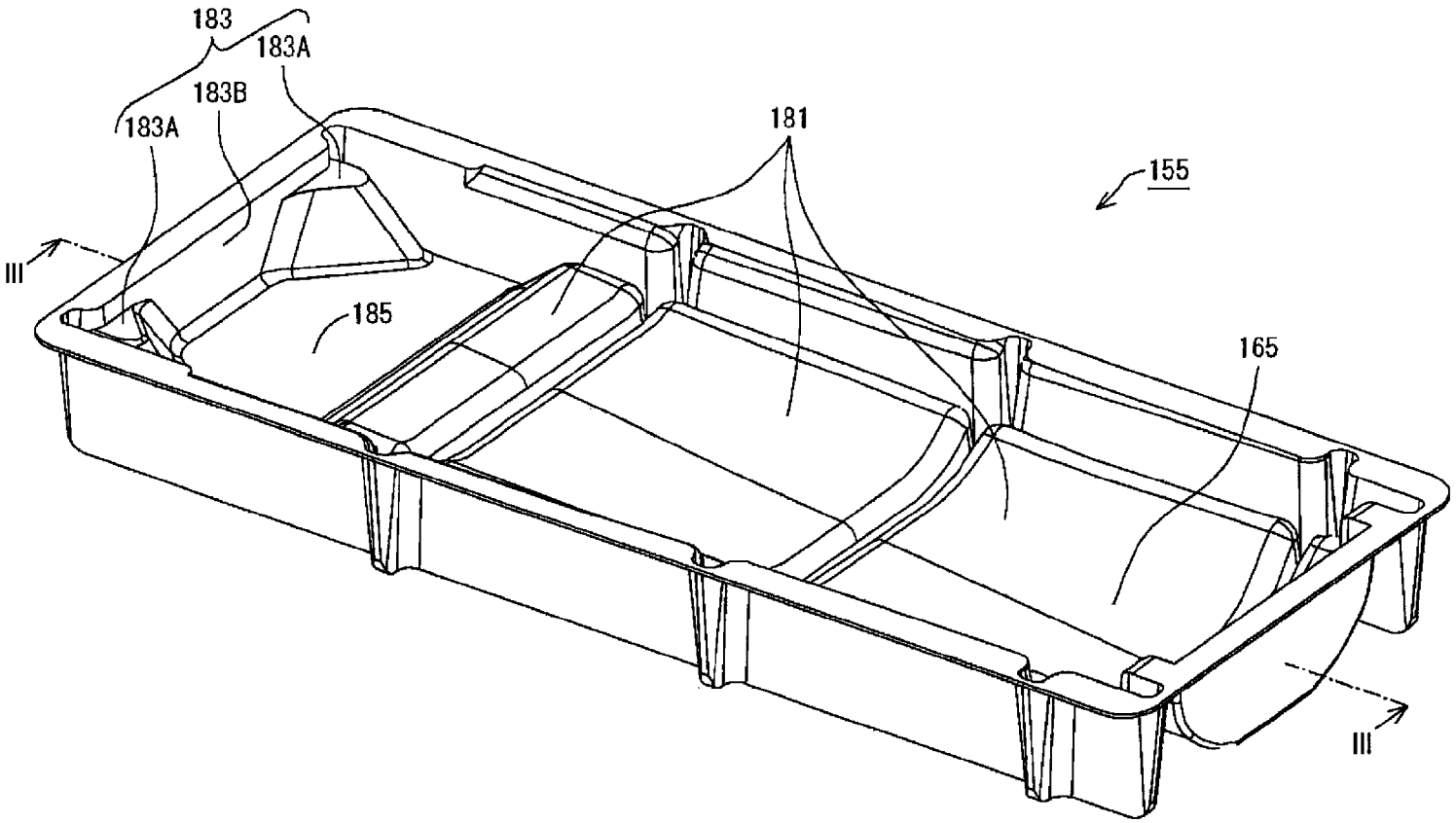
FIG. 23 is a perspective view showing the packaging tray according to the embodiment.

As shown in FIG. 23, each packaging tray 155 has a sloping portion 181 and a restricting portion 183. The sloping portion 181 is formed in the recess 165. The restricting portion 183 is provided within the recess 165. The restricting portion 183 includes first restricting portions 183A and a second restricting portion 183B. The first restricting portions 183A protrude from the bottom portion 185 of the packaging tray 155 toward an opening of the recess 165. The second restricting portion 183B is configured as a portion of an inner wall of the recess 165.

Figure 24:
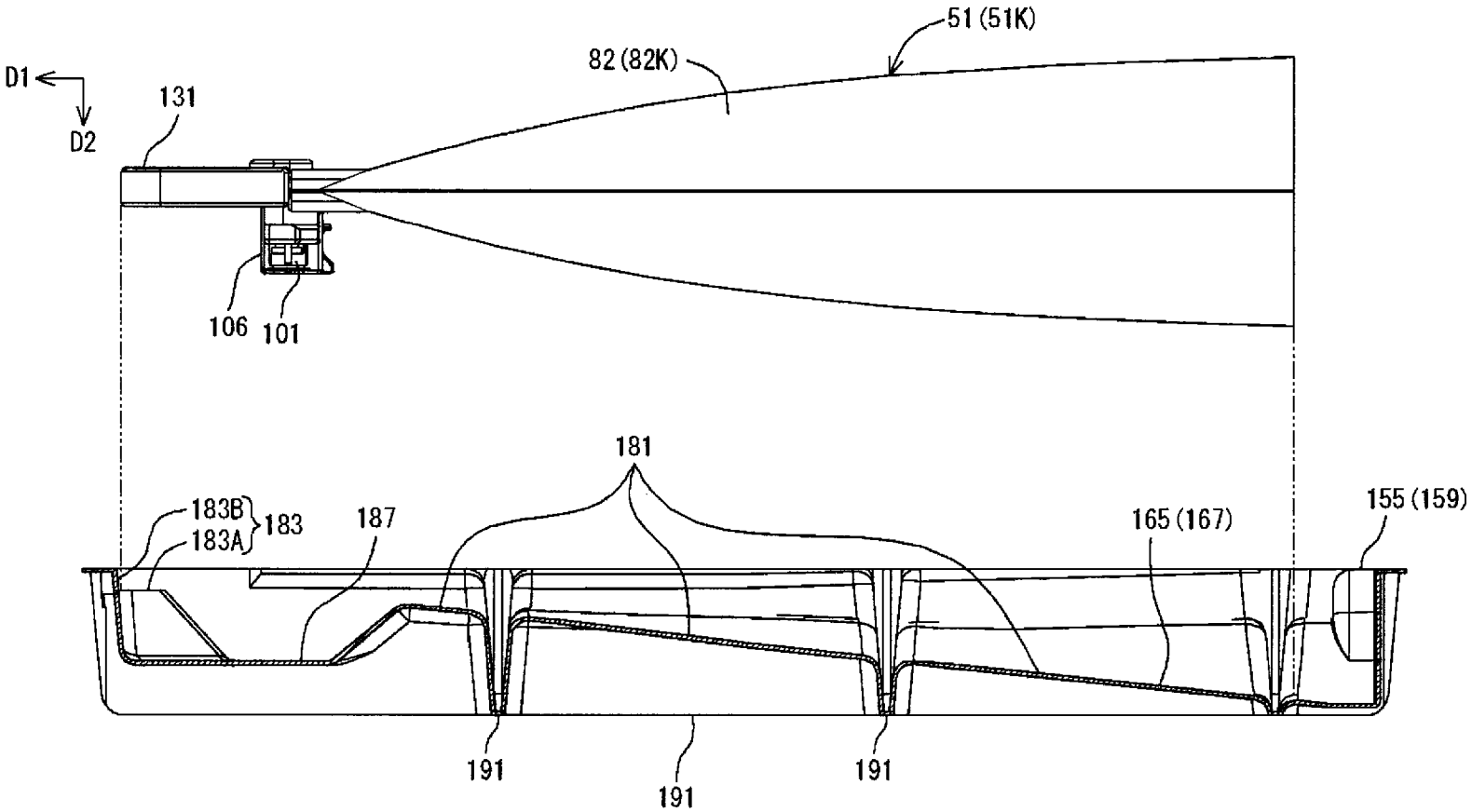
FIG. 24 is a diagram showing a cross section of the packaging tray and the ink container according to the embodiment.

As shown in FIG. 24, the sloping portion 181 is formed in a region of the recess 165 that opposes the ink bag 82. The sloping portion 181 is sloped in such a direction that the depth of the recess 165 decreases from the side of the ink bag 82 toward the side of the handle portion 131. The first restricting portions 183A are located on the first direction D1 side relative to the sloping portion 181. The second restricting portion 183B also is located on the first direction D1 side relative to the sloping portion 181. A recess 187 is formed between the sloping portion 181 and the first restricting portions 183A in the first direction D1. The recess 187 is formed in a position that opposes the supply portion 101 and the board mounting portion 106 of the ink container 51. It should be noted that in order to clarify the configuration, FIG. 24 shows a cross section of the packaging tray 155 (packaging tray 159) taken along line in FIG. 23.

Figure 25:
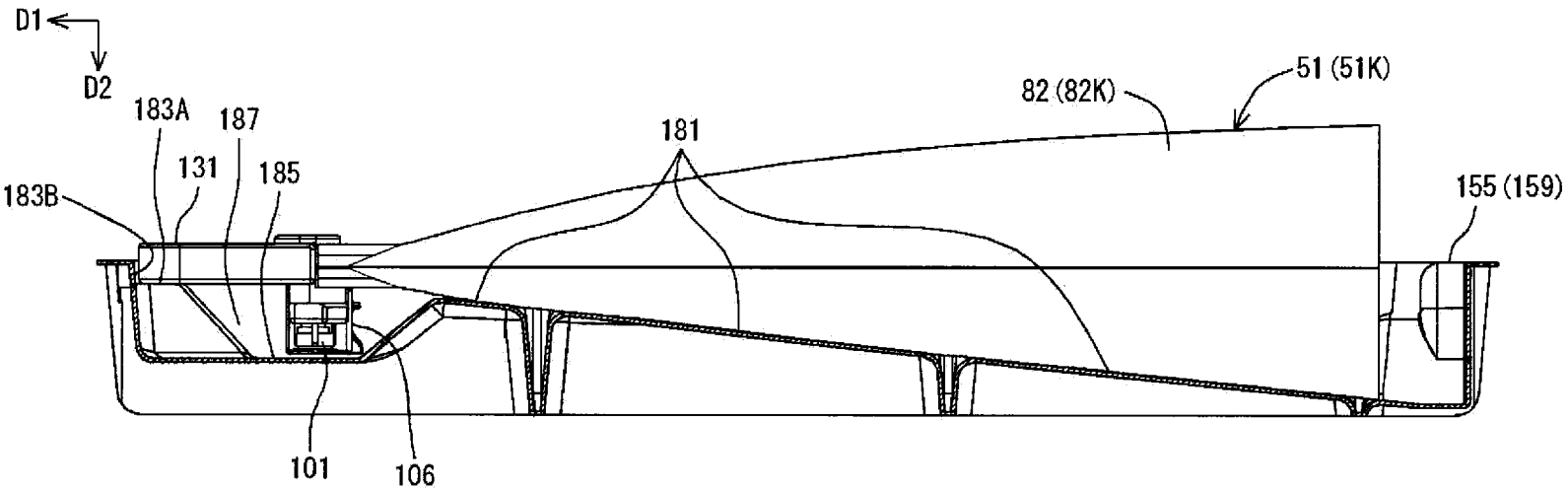
FIG. 25 is a diagram showing a cross section of the packaging tray and the ink container according to the embodiment.

When the ink container 51 is placed on the packaging tray 155, the ink bag 82 of the ink container 51 conforms to the sloping portion 181 of the packaging tray 155, as shown in FIG. 25. At this time, the position of the handle portion 131 of the ink container 51 in the second direction D2 is restricted by the first restricting portions 183A. Then, the supply portion 101 and the board mounting portion 106 of the ink container 51 are contained within the recess 187. Also, at this time, clearances from the supply portion 101 and the board mounting portion 106 to the bottom portion 185 of the recess 187 are maintained. That is to say, the first restricting portions 183A restrict the handle portion 131 at such a position that a clearance is maintained between the supply portion 101 and the bottom portion 185 of the packaging tray 155. Also, the first restricting portions 183A restrict the handle portion 131 at such a position that a clearance is maintained between the board mounting portion 106 and the bottom portion 185 of the packaging tray 155. Thus, a clearance is maintained between the circuit board 105 and the bottom portion 185 of the packaging tray 155. It should be noted that in order to clarify the configuration, FIG. 25 shows a cross section of the packaging tray 155 (packaging tray 159) taken along line in FIG. 23.

Moreover, when the ink container 51 is placed on the packaging tray 155, the position of the handle portion 131 of the ink container 51 in the first direction D1 is restricted by the second restricting portion 183B. At this time, clearances from the supply portion 101 and the board mounting portion 106 to the inner wall of the recess 165 are maintained in the first direction D1. That is to say, with respect to the first direction D1, the second restricting portion 183B restricts the handle portion 131 at such a position that a clearance is maintained between the supply portion 101 and the inner wall of the packaging tray 155. Also, with respect to the first direction D1, the second restricting portion 183B restricts the handle portion 131 at such a position that a clearance is maintained between the board mounting portion 106 and the inner wall of the packaging tray 155. Thus, a clearance is maintained between the circuit board 105 and the inner wall of the packaging tray 155.

The packaging tray 159 will be described. The packaging tray 159 is larger than the packaging tray 155. Also, the packaging tray 159 differs from the packaging tray 155 in the configuration of the restricting portion 183. Otherwise, the packaging tray 159 has the same configuration as the packaging tray 155. Therefore, in the following description, among the components of the packaging tray 159, those components that are the same as the components of the packaging tray 155 are denoted by the same reference numerals as the components of the packaging tray 155, and detailed descriptions thereof are omitted.

Figure 26:
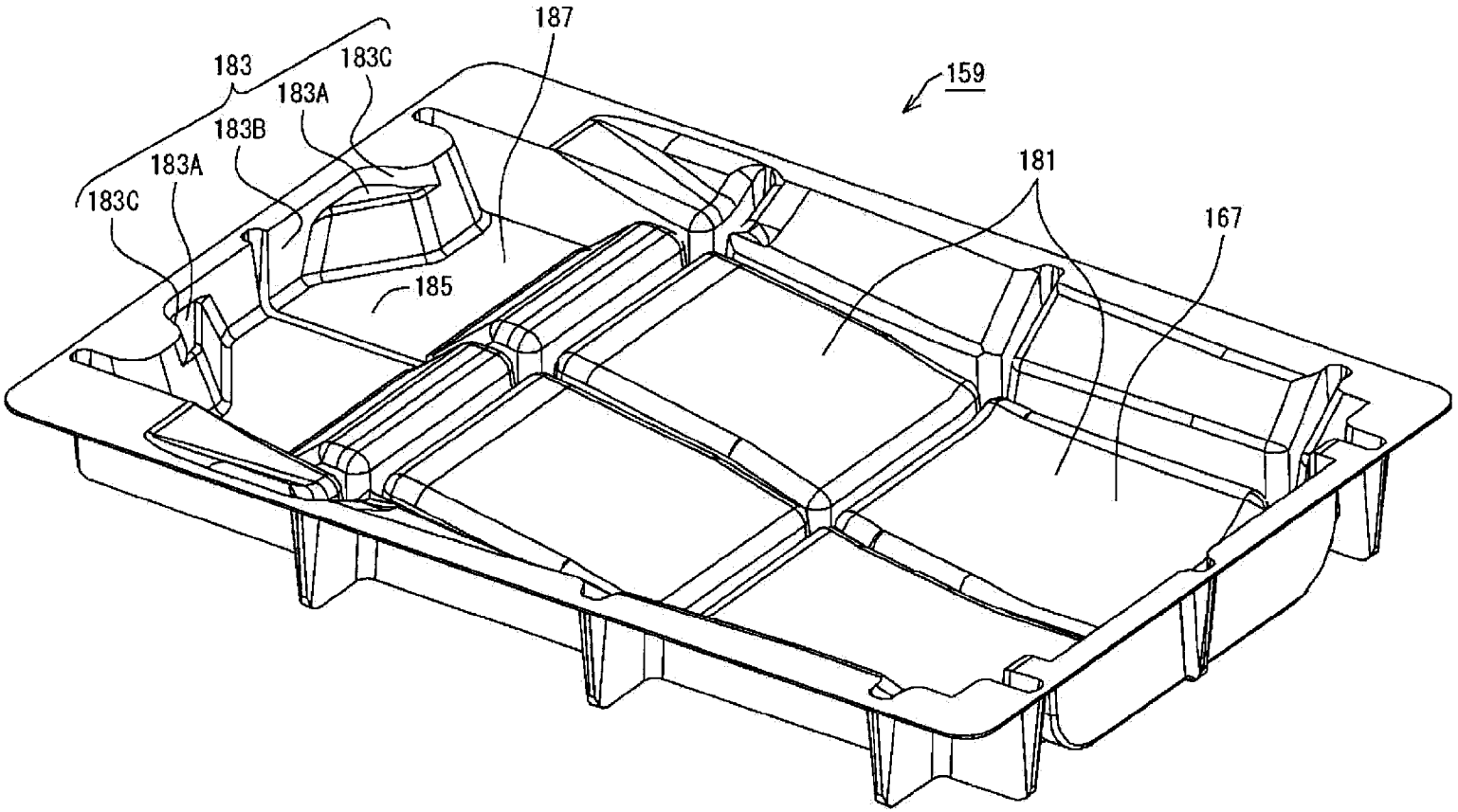
FIG. 26 is a perspective view showing the packaging tray according to the embodiment.

In the packaging tray 159, as shown in FIG. 26, the restricting portion 183 includes third restricting portions 183C. The third restricting portions 183C are located outward of a region between the two first restricting portions 183A. The third restricting portions 183C protrude to the side that is opposite to the side of the bottom portion 185 beyond the first restricting portions 183A. Moreover, the third restricting portions 183C protrude to the side of the sloping portion 181 beyond the second restricting portion 183B.

When the ink container 51K is placed on the packaging tray 159, the ink bag 82K of the ink container 51K conforms to the sloping portion 181 of the packaging tray 159 (FIG. 25). At this time, the position of the handle portion 131 of the ink container 51K in the second direction D2 is restricted by the first restricting portions 183A. Then, the supply portion 101 and the board mounting portion 106 of the ink container 51K are contained within the recess 187. Also, at this time, clearances from the supply portion 101 and the board mounting portion 106 to the bottom portion 185 of the recess 187 are maintained (FIG. 25). That is to say, also in the packaging tray 159, the first restricting portions 183A restrict the handle portion 131 at such a position that a clearance is maintained between the supply portion 101 and the bottom portion 185 of the packaging tray 159. Similarly, the first restricting portions 183A restrict the handle portion 131 at such a position that a clearance is maintained between the board mounting portion 106 and the bottom portion 185 of the packaging tray 155. Thus, a clearance is maintained between the circuit board 105 and the bottom portion 185 of the packaging tray 155.

Moreover, when the ink container 51K is placed on the packaging tray 159, the position of the handle portion 131 of the ink container 51K in the first direction D1 is restricted by the second restricting portion 183B. At this time, with respect to the first direction D1, clearances from the supply portion 101 and the board mounting portion 106 to the inner wall of the recess 167 are maintained. That is to say, with respect to the first direction D1, the second restricting portion 183B restricts the handle portion 131 at such a position that a clearance is maintained between the supply portion 101 and the inner wall of the packaging tray 155. Also, with respect to the first direction D1, the second restricting portion 183B restricts the handle portion 131 at such a position that a clearance is maintained between the board mounting portion 106 and the inner wall of the packaging tray 155. Thus, a clearance is maintained between the circuit board 105 and the inner wall of the packaging tray 155.

Figure 27:
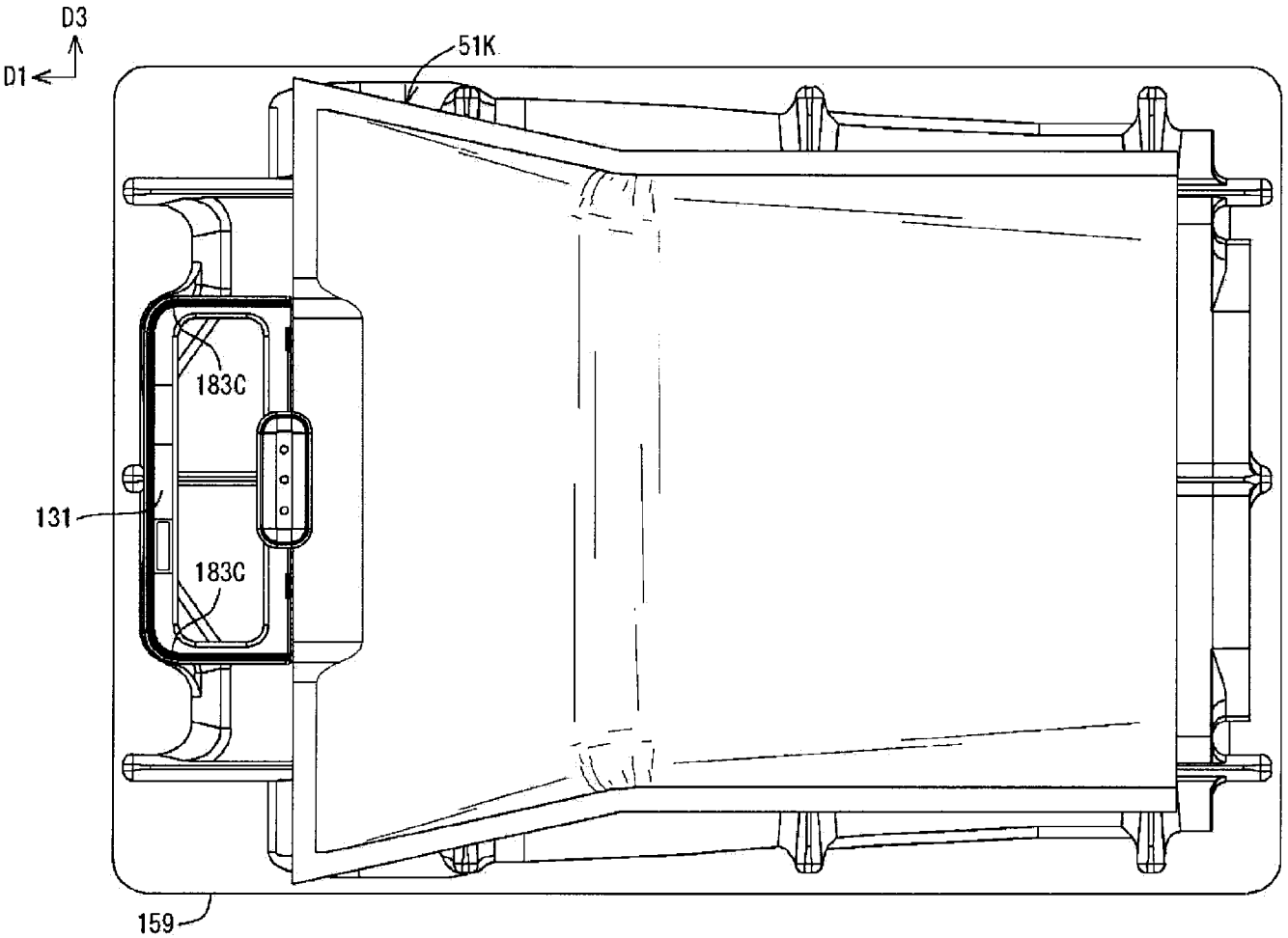
FIG. 27 is a plan view showing the ink container and the packaging tray according to the embodiment.

Furthermore, when the ink container 51K is placed on the packaging tray 159, as shown in FIG. 27, the position of the handle portion 131 of the ink container 51K in the third direction D3 is restricted by the third restricting portions 183C. At this time, with respect to the third direction D3, clearances from the supply portion 101 and the board mounting portion 106 to the inner wall of the recess 167 are maintained. That is to say, with respect to the third direction D3, the third restricting portions 183C restrict the handle portion 131 at such a position that a clearance is maintained between the supply portion 101 and the inner wall of the packaging tray 159. Similarly, with respect to the third direction D3, the third restricting portions 183C restrict the handle portion 131 at such a position that a clearance is maintained between the board mounting portion 106 and the inner wall of the packaging tray 159. Thus, a clearance is maintained between the circuit board 105 and the inner wall of the packaging tray 159.

Figure 28:
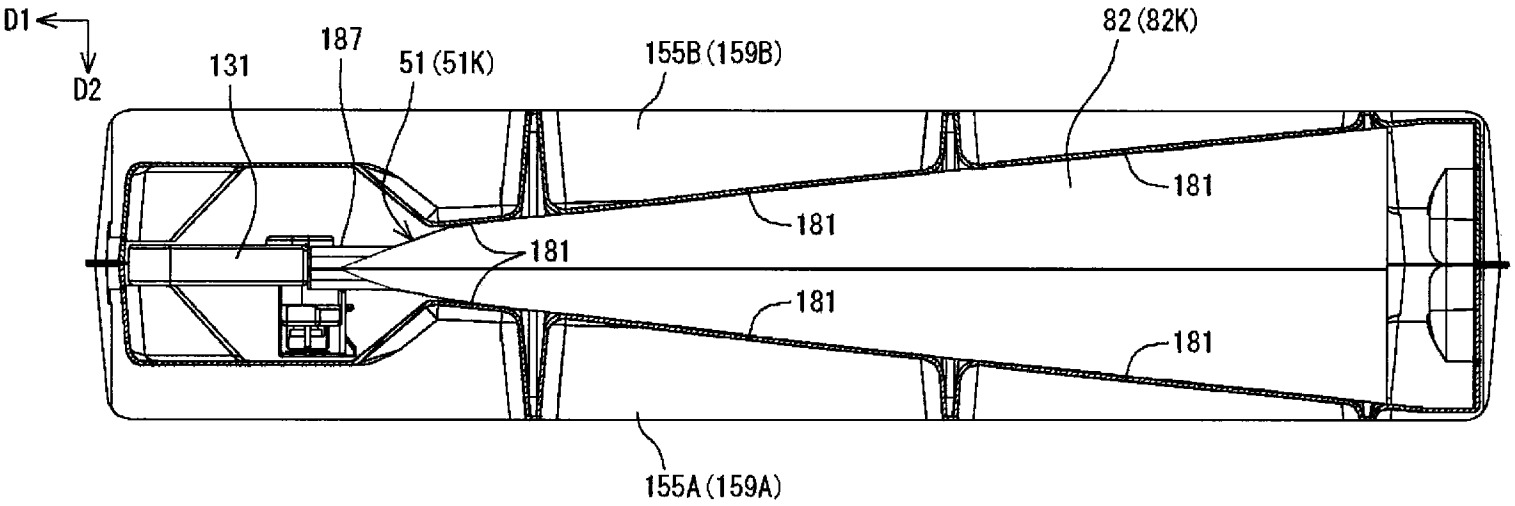
FIG. 28 is a diagram showing a cross section of the packaging trays and the ink container according to the embodiment.

In the package 151, as shown in FIG. 28, the ink container 51 is sandwiched by the packaging tray 155A and the packaging tray 155B. Similarly, in the package 151K, the ink container 51K is sandwiched by the packaging tray 159A and the packaging tray 159B as well. Thus, the position of the handle portion 131 in a direction that is opposite to the second direction D2 is restricted by the restricting portion 183 of the packaging tray 155B or the packaging tray 159B.

Moreover, the ink bag 82 is sandwiched by the sloping portion 181 of the packaging tray 155A and the sloping portion 181 of the packaging tray 155B. Similarly, the ink bag 82K is sandwiched by the sloping portion 181 of the packaging tray 159A and the sloping portion 181 of the packaging tray 159B. Thus, for example, during transport or the like, when the ink within the ink container 51 shakes and moves from the side of the ink bag 82 toward the side of the handle portion 131, the momentum of the shaking ink can be alleviated by the sloping portions 181. Thus, the collision of the supply portion 101 and the board mounting portion 106 with the packaging trays 155 or the packaging trays 159 due to the momentum of the shaking ink is easily avoided. Moreover, the force that is exerted on the fusion-bonding portion 86 between the handle portion 131 and the ink bag 82 due to the momentum of the shaking ink can thus be reduced. Therefore, damage to the fusion-bonding portion 86 between the handle portion 131 and the ink bag 82 is easily avoided.

Figure 29:
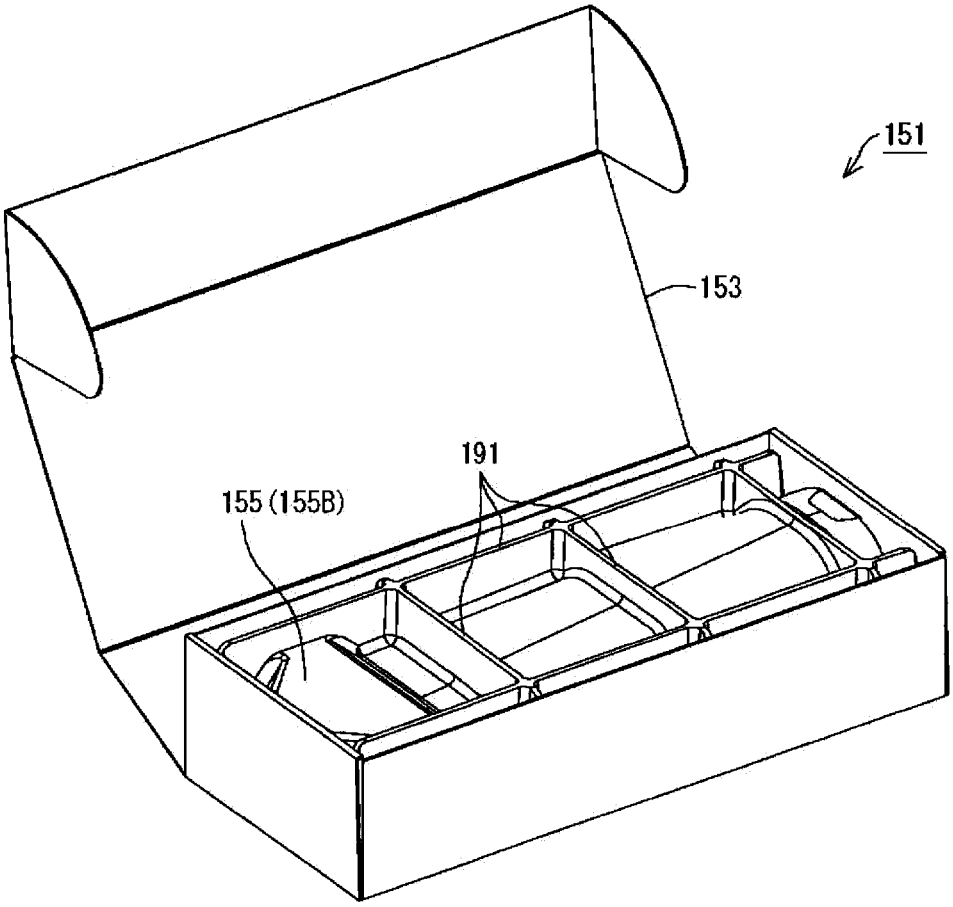
FIG. 29 is a perspective view showing the package according to the embodiment.
Figure 30:
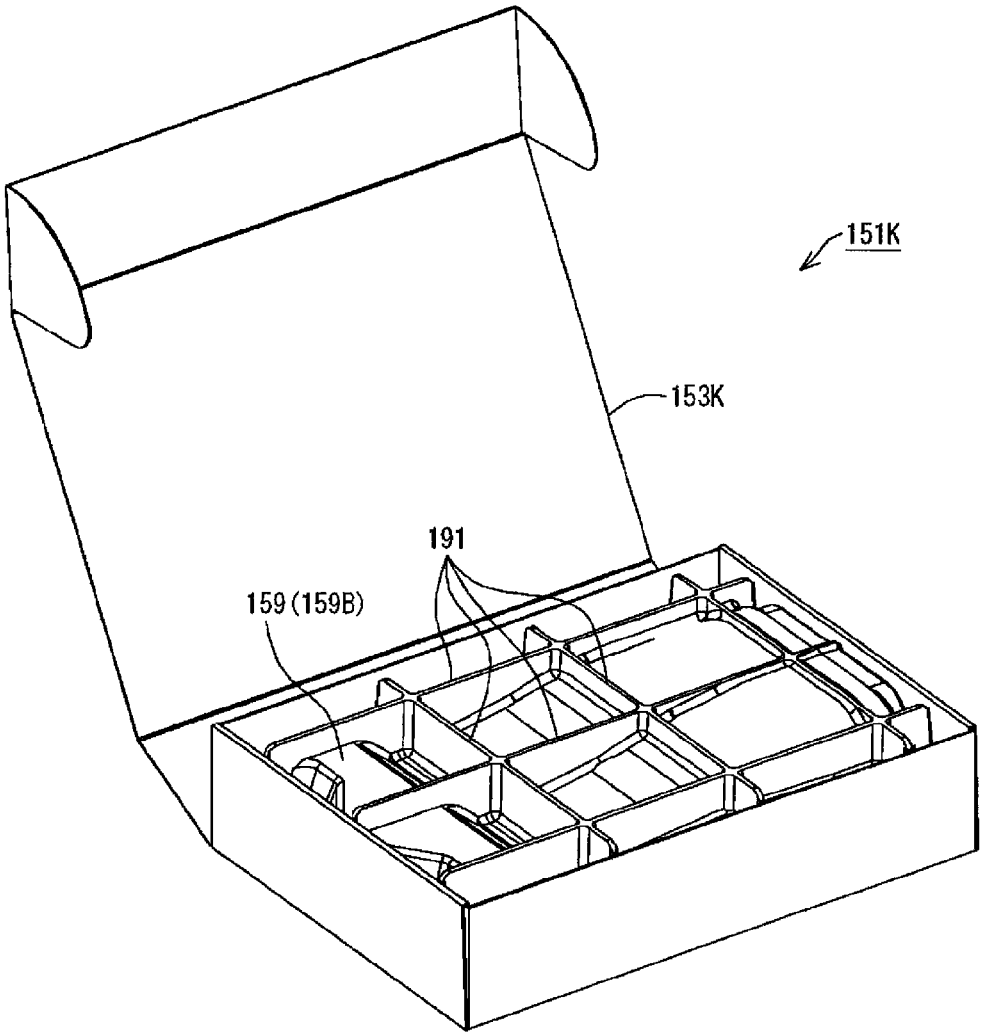
FIG. 30 is a perspective view showing the package according to the embodiment.

In the package 151, as shown in FIG. 29, the ink container 51 is contained in the packing box 153 together with the two packaging trays 155 in a state in which the ink container 51 is sandwiched by the two packaging trays 155. Similarly, in the package 151K, as shown in FIG. 30, the ink container 51K is contained in the packing box 153K together with the two packaging trays 159 in a state in which the ink container 51K is sandwiched by the two packaging trays 159. As shown in FIG. 29, the packaging trays 155 are provided with ribs 191. Similarly, as shown in FIG. 30, the packaging trays 159 also are provided with the ribs 191.

As shown in FIG. 24, the ribs 191 are formed on the back side of the recess 165 or the recess 167. The ribs 191 protrude to a side that is opposite to the side of the recess 165 or the side of the recess 167. Therefore, as shown in FIG. 29, when the packing box 153 is opened, the ribs 191 are exposed to the outside of the packing box 153. Thus, the worker can open the packing box 153 and hold the rib 191 of the packaging tray 155B with the fingers. Accordingly, after opening the packing box 153, the worker easily holds the rib 191 of the packaging tray 155B with the fingers and removes the packaging tray 155B from the packing box 153. The same applies to the package 151K shown in FIG. 30.

It should be noted that a configuration may also be adopted in which in the package 151 or the package 151K, the ink container 51 or the ink container 51K is sandwiched by the packaging trays 155 or the packaging trays 159 after being enclosed in a bag made of a synthetic resin. With this configuration, even when the ink leaks out of the ink container 51, the leakage of the leaking ink to the outside of the package 151 or the package 151K is easily suppressed. Moreover, with this configuration, unsteadiness of the ink container 51 or the ink container 51K within the packaging tray 155 or the packaging tray 159 can be reduced. Therefore, with this configuration, damage to the ink container 51 or the ink container 51K in the package 151 or the package 151K is even more easily avoided.

In the packaging tray 155 and the packaging tray 159 according to the present embodiment, the position of the handle portion 131 is restricted by the restricting portion 183, so that a clearance is maintained between the supply portion 101 and the packaging tray 155 or the packaging tray 159. That is to say, in the packaging tray 155 and the packaging tray 159 according to the present embodiment, the supply portion 101 can be prevented from coming into contact with the packaging tray 155 or the packaging tray 159 by restricting the position of the handle portion 131. Thus, breakage of the supply portion 101 caused by the supply portion 101 coming into contact with the packaging tray 155 or the packaging tray 159 is easily suppressed.

Moreover, in the packaging tray 155 and the packaging tray 159 according to the present embodiment, when the ink within the ink container 51 shakes and moves from the side of the ink bag 82 toward the side of the handle portion 131, the momentum of the shaking ink can be alleviated by the sloping portion 181. Thus, the collision of the supply portion 101 with the packaging tray 155 or the packaging tray 159 due to the momentum of the shaking ink is easily avoided.

Moreover, in the packaging tray 155 and the packaging tray 159 according to the present embodiment, when the ink within the ink container 51 shakes and moves from the side of the ink bag 82 toward the side of the handle portion 131, the momentum of the shaking ink can be alleviated by the sloping portion 181. Thus, the force that is exerted on the fusion-bonding portion 86, which is the joint portion between the handle portion 131 and the ink bag 82, due to the momentum of the shaking ink can be reduced. Therefore, damage to the fusion-bonding portion 86 between the handle portion 131 and the ink bag 82 is easily avoided.

Moreover, in the packaging tray 155 and the packaging tray 159 according to the present embodiment, the position of the handle portion 131 is restricted by the restricting portion 183, so that a clearance is maintained between the circuit board 105 of the ink container 51 and the packaging tray 155 or the packaging tray 159. That is to say, in the packaging tray 155 and the packaging tray 159 according to the present embodiment, the circuit board 105 can be prevented from coming into contact with the packaging tray 155 or the packaging tray 159 by restricting the position of the handle portion 131. Thus, breakage of the circuit board 105 of the ink container 51 caused by the circuit board 105 coming into contact with the packaging tray 155 or the packaging tray 159 is easily suppressed.

Moreover, in the package 151 and the package 151K according to the present embodiment, the gusset portion 163 can be kept in an expanded state by the spacer 157 or the spacer 161. Thus, deformation that repeatedly occurs in the gusset portion 163 when, for example, the package 151 or the package 151K is shaken can be reduced. Therefore, fatigue failure caused by repeatedly occurring deformation is easily suppressed.

Moreover, in the package 151 according to the present embodiment, since the ink container 51 and the packaging trays 155 can be contained in the packing box 153, the ink container 51 and the packaging trays 155 are easily protected. Similarly, in the package 151K according to the present embodiment, since the ink container 51K and the packaging trays 159 can be contained in the packing box 153K, the ink container 51K and the packaging trays 159 are easily protected.

The entire disclosure of Japanese Patent Application No. 2014-096558, filed May 8, 2014 is expressly incorporated by reference herein.

What is claimed is:

1. A packaging tray for a liquid container,
the liquid container comprising:
a flexible liquid containing portion containing ink; and
a flow passage member including a liquid, introduction port communicating with an interior of the flexible liquid containing portion and configured to introduce the ink, a liquid outlet portion communication with the liquid introduction port and configured to supply ink outside of the liquid container, and a handle portion,
the liquid outlet portion being located between the handle portion and the flexible liquid containing portion in a first direction;
the packaging tray comprising:
a restricting portion that restricts the handle portion at such a position that a clearance is maintained between the liquid outlet portion of the liquid container and the packaging tray.

2. The packaging tray according to claim 1,
wherein the packaging tray further includes a sloping portion opposing a region of the flexible liquid containing portion that is located on a side opposite to the handle portion with respect to the liquid outlet portion.

3. A packaging body, comprising:
the packaging tray according to claim 2, and
the liquid container.

4. The packaging tray according to claim 1, further comprising:
a recess that is configured to receive the flexible liquid containing portion,
the recess including a sloping portion and a depth of the recess decreases from a side of the flexible liquid containing portion toward a side of the handle portion along the first direction.

5. A packaging body, comprising:
the packaging tray according to claim 4, and
the liquid container.

6. The packaging tray according to claim 1,
wherein an end surface of the liquid outlet portion of the liquid container is directed in a second direction that intersects the first direction, the first direction being a direction in which the handle portion protrudes, and
the restricting portion restricts the position of the handle portion in the second direction.

7. A packaging body, comprising:

the packaging tray according to claim 6, and the liquid container.

8. The packaging tray according to claim 1, wherein an end surface of the liquid outlet portion of the liquid container is directed in a second direction that intersects the first direction, the first direction being a direction in which the handle portion protrudes, and the restricting portion restricts the position of the handle portion in a third direction that intersects both of the first direction and the second direction.

9. A packaging body, comprising:

the packaging tray according to claim 8, and the liquid container.

10. The packaging tray according to claim 1, wherein an end surface of the liquid outlet portion of the liquid container is directed in a second direction that intersects the first direction, the first direction being a direction in which the handle portion protrudes, and the restricting portion restricts the position of the handle portion in the first direction.

11. A packaging body, comprising:

the packaging tray according to claim 10, and the liquid container.

12. The packaging tray according to claim 1, wherein the liquid container has an electrical connection portion electrically connectable to an electric circuit of a liquid ejection apparatus, and the restricting portion being configured to support the handle portion to keep the handle portion at such a position that a clearance is maintained between the electrical connection portion and the packaging tray.

13. A packaging body, comprising:

the packaging tray according to claim 12, and the liquid container.

14. A packaging body, comprising:

the packaging tray according to claim 1, and the liquid container.

15. The packaging body according to claim 14, wherein the liquid container has a gusset portion in the flexible liquid containing portion, and the packaging body further includes a spacer that is inserted into the gusset portion and keeps the gusset portion in an expanded state.

16. The packaging body according to claim 14, comprising:

an exterior box containing the liquid container and the packaging tray.

* * * * *